US010391779B2

(12) United States Patent
Katoh et al.

(10) Patent No.: US 10,391,779 B2
(45) Date of Patent: Aug. 27, 2019

(54) LIQUID DISCHARGE APPARATUS

(71) Applicants: Tomomi Katoh, Kanagawa (JP); Yuta Moriwaki, Kanagawa (JP); Satoru Yoshida, Ibaraki (JP)

(72) Inventors: Tomomi Katoh, Kanagawa (JP); Yuta Moriwaki, Kanagawa (JP); Satoru Yoshida, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/990,273

(22) Filed: May 25, 2018

(65) Prior Publication Data

US 2018/0339519 A1 Nov. 29, 2018

(30) Foreign Application Priority Data

May 29, 2017 (JP) ..... 2017-105333
Apr. 17, 2018 (JP) ..... 2018-078973

(51) Int. Cl.

| | |
|---|---|
| ***B41J 2/175*** | (2006.01) |
| ***B41J 2/045*** | (2006.01) |
| ***B41J 2/055*** | (2006.01) |
| ***B41J 2/14*** | (2006.01) |
| ***B41J 2/18*** | (2006.01) |
| ***B41J 29/38*** | (2006.01) |

(52) U.S. Cl.

CPC ..... *B41J 2/17556* (2013.01); *B41J 2/04508* (2013.01); *B41J 2/04583* (2013.01); *B41J 2/04588* (2013.01); *B41J 2/055* (2013.01); *B41J 2/14274* (2013.01); *B41J 2/175* (2013.01); *B41J 2/17513* (2013.01); *B41J 2/18* (2013.01); *B41J 29/38* (2013.01); *B41J 2002/14483* (2013.01); *B41J 2202/02* (2013.01); *B41J 2202/12* (2013.01); *B41J 2202/20* (2013.01)

(58) Field of Classification Search

CPC ..... B41J 2/17556; B41J 2/04508; B41J 2/04583; B41J 2/04588; B41J 2/055; B41J 2/14274; B41J 2/175; B41J 2/17513; B41J 2/18; B41J 29/38; B41J 2002/14483; B41J 2202/02; B41J 2202/20
See application file for complete search history.

(56) References Cited

U.S. PATENT DOCUMENTS

| | | | | |
|---|---|---|---|---|
| 2011/0109706 | A1* | 5/2011 | Murray | B41J 2/175 347/92 |
| 2012/0236094 | A1 | 9/2012 | Katoh | |
| 2013/0187985 | A1 | 7/2013 | Katoh et al. | |
| 2013/0241994 | A1 | 9/2013 | Katoh | |
| 2018/0134033 | A1 | 5/2018 | Sawase | |

FOREIGN PATENT DOCUMENTS

| | | |
|---|---|---|
| JP | 2008-143027 | 6/2008 |
| JP | 2010-083021 | 4/2010 |
| JP | 2013-184353 | 9/2013 |

* cited by examiner

*Primary Examiner* — Thinh H Nguyen
(74) *Attorney, Agent, or Firm* — Duft & Bornsen, PC

(57) ABSTRACT

A liquid discharge apparatus includes a plurality of liquid discharge heads to discharge liquid, and a plurality of head tanks communicating with the plurality of liquid discharge heads, respectively. Each of the plurality of head tanks includes a liquid chamber to store the liquid and a gas chamber separated from the liquid chamber by a diaphragm, and the gas chamber of one of the plurality of head tanks communicates with the gas chamber of another of the plurality of head tanks.

11 Claims, 15 Drawing Sheets

LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2017-105333, filed on May 29, 2017, and Japanese Patent Application No. 2018-078973, filed on Apr. 17, 2018, in the Japan Patent Office, the entire disclosure of each of which is hereby incorporated by reference herein.

BACKGROUND

Technical Field

Aspects of the present disclosure relate to a liquid discharge apparatus.

Related Art

In an inkjet type image forming apparatus, a technique for providing a damping function in a sub tank and reducing a pressure fluctuation is known.

However, the pressure fluctuation is damped in one tank for a plurality of heads. Thus, the effect of reducing the pressure fluctuation is not sufficient.

SUMMARY

In an aspect of this disclosure, an improved liquid discharge apparatus includes a plurality of liquid discharge heads to discharge liquid, and a plurality of head tanks communicating with the plurality of liquid discharge heads, respectively. Each of the plurality of head tanks includes a liquid chamber to store the liquid and a gas chamber separated from the liquid chamber by a diaphragm, and the gas chamber of one of the plurality of head tanks communicates with the gas chamber of another of the plurality of head tanks.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
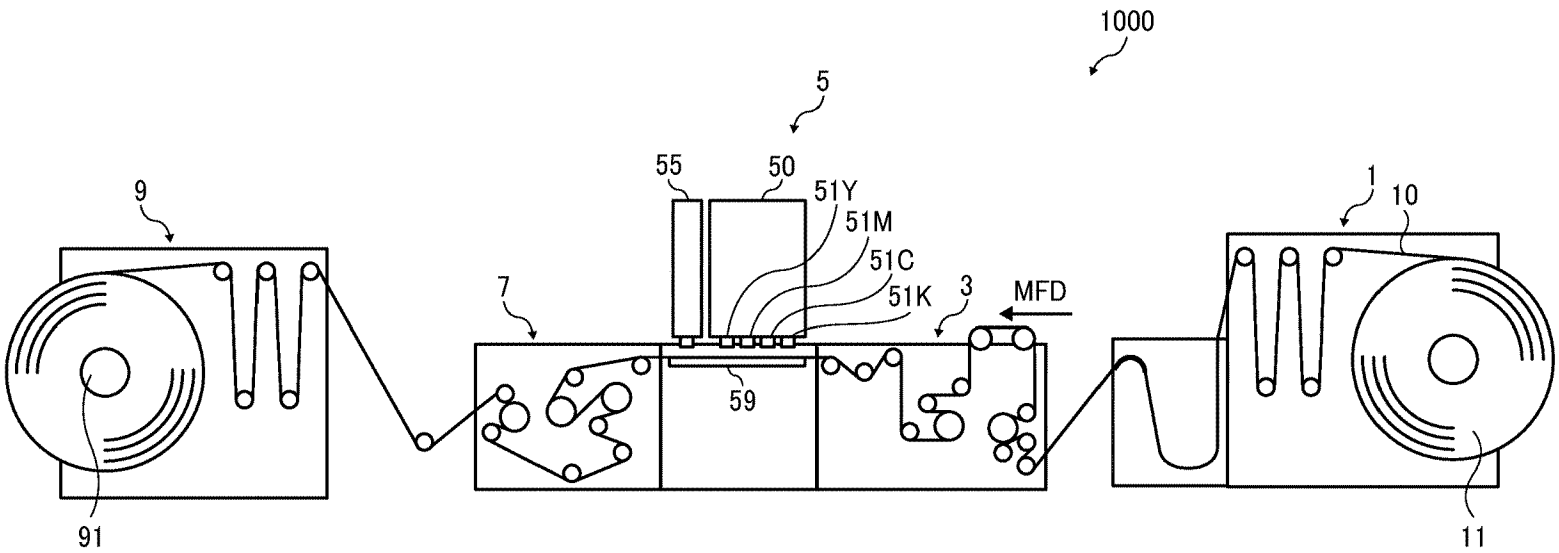
FIG. 1 is a schematic front view of a printer as an example of a liquid discharge apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in an analogous manner, and achieve similar results.

Although the embodiments are described with technical limitations with reference to the attached drawings, such description is not intended to limit the scope of the disclosure and all the components or elements described in the embodiments of this disclosure are not necessarily indispensable. As used herein, the singular forms "a", "an", and "the" are intended to include the plural forms as well, unless the context clearly indicates otherwise.

Hereinafter, embodiments according to the present disclosure are described below with reference to FIGS. 1 to 16.

[First Embodiment]

Figure 7A:
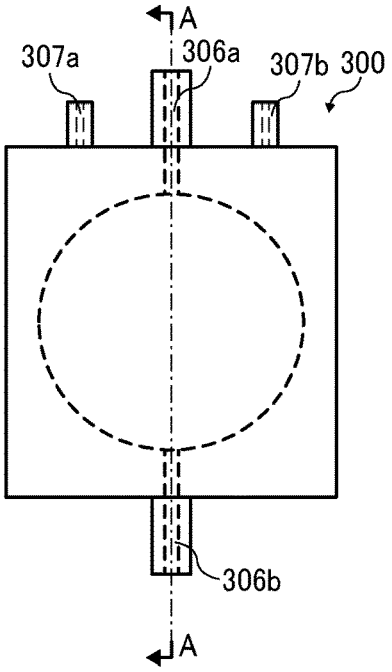
FIGS. 7A and 7B are a front view and a cross sectional view of a head tank, respectively, according to the first embodiment.
Figure 7B:
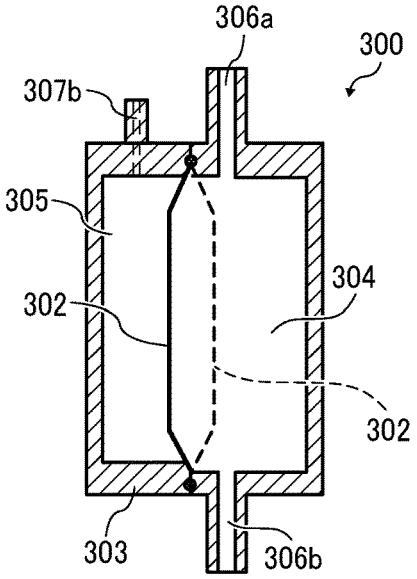
Figure 8:
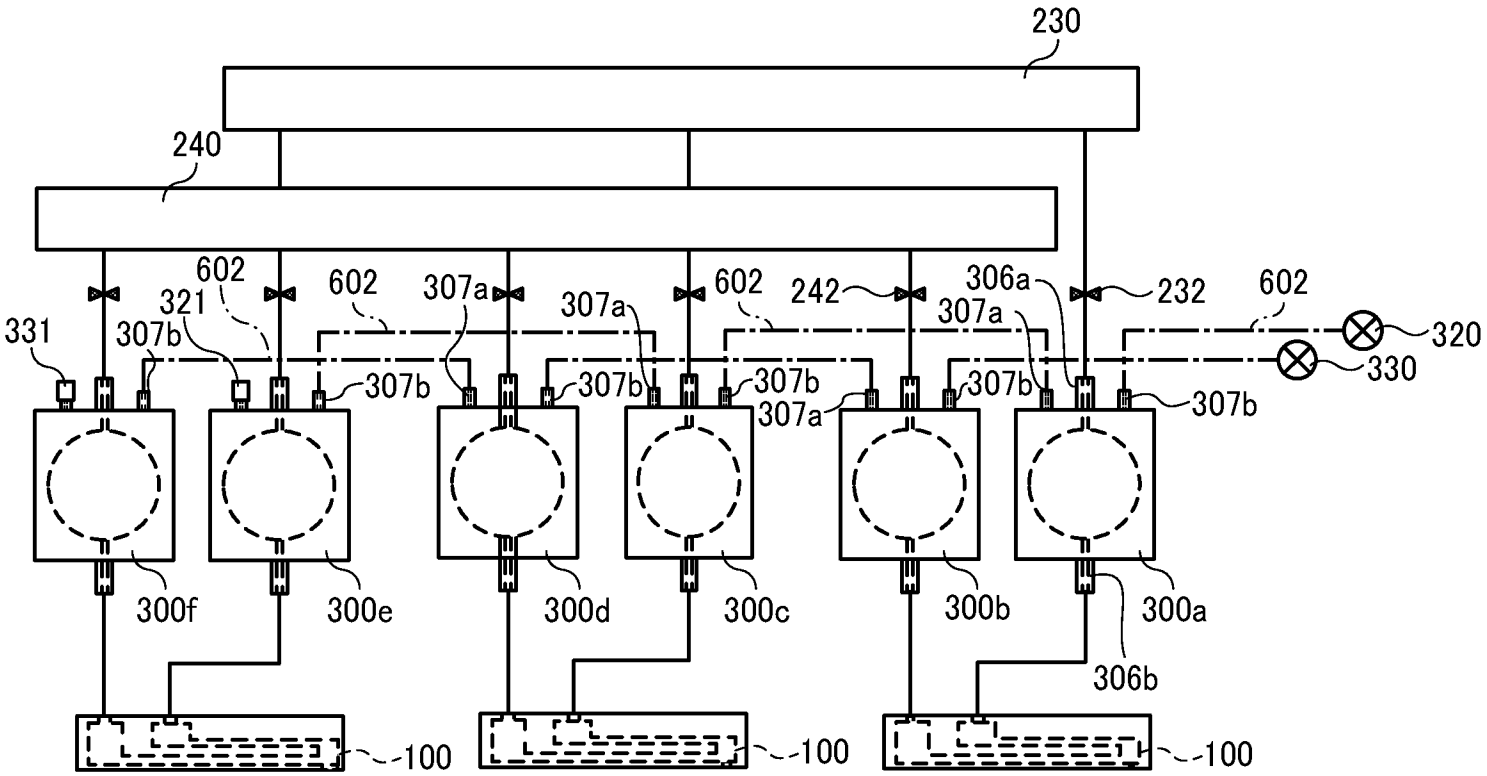
FIG. 8 is an exploded circuit diagram of the liquid circulation apparatus according to the first embodiment.

As illustrated in FIGS. 1 through 5, a liquid discharge apparatus (printer 1000) according to the present disclosure includes a plurality of liquid discharge heads 100 (see FIGS. 3 and 4) that discharge liquid and a plurality of head tanks 300 (see FIG. 5) communicating with the plurality of liquid discharge heads 100, respectively. Hereinafter, the "liquid discharge head" is simply referred to as a "head". As illustrated in FIGS. 7A and 7B, each of the head tanks 300 includes a liquid chamber 304 that stores liquid and a gas chamber 305 separated from the liquid chamber 304 by a diaphragm 302. As illustrated in FIG. 8, the gas chamber 305 of one of the head tanks 300 communicates with the gas chamber 305 of another head tank 300.

Further, as illustrated in FIG. 8, the liquid discharge apparatus includes a liquid channel through which the liquid is circulated via the head 100, first head tanks 300*a*, 300*c*, and 300*e*, and second head tanks 300*b*, 300*d*, and 300*f*. The first head tanks 300*a*, 300*c*, and 300*e* are connected to supply ports 171 of the heads 100 with liquid channels, respectively. The second head tanks 300*b*, 300*d*, and 300*f* are connected to discharge ports 181 of the heads 100 with liquid channels, respectively. The gas chamber 305 of the first head tank 300*a* communicates with the gas chambers 305 of the other first head tanks 300*c* and 300*e*. Further, the gas chamber 305 of the second head tank 300*b* communicates with the gas chambers 305 of the other second head tanks 300*d* and 300*f*.

[Printer]

A printer 1000 that is an example of a liquid discharge apparatus according to a first embodiment of the present disclosure is described in detail below with reference to FIGS. 1 and 2.

FIG. 1 is a schematic front view of the printer 1000. FIG. 2 is a plan view of a first head unit 50 of the printer 1000 of FIG. 1. The printer 1000 according to the present embodiment includes a feeder 1 to feed a continuous medium 10, a guide conveyor 3 to guide and convey the continuous medium 10, fed from the feeder 1, to a printing unit 5, the printing unit 5 to discharge liquid onto the continuous medium 10 to form an image on the continuous medium 10, a dryer 7 to dry the continuous medium 10, and an ejector 9 to eject the continuous medium 10.

The continuous medium 10 is fed from a winding roller 11 of the feeder 1, guided and conveyed with rollers of the feeder 1, the guide conveyor 3, the dryer 7, and the ejector 9, and wound around a winding roller 91 of the ejector 9.

In the printing unit 5, the continuous medium 10 is conveyed opposite a first head unit 50 and a second head unit 55 on a conveyance guide 59. The first head unit 50 discharges liquid to form an image on the continuous medium 10. Post-treatment is performed on the continuous medium 10 with treatment liquid discharged from the second head unit 55.

Here, the first head unit 50 includes, for example, four-color full-line head arrays 51K, 51C, 51M, and 51Y (hereinafter, collectively referred to as "head array 51" unless colors are distinguished) from an upstream side in a feed direction of the continuous medium 10 (hereinafter, "medium feed direction") indicated by arrow MFD in FIGS. 1 and 2.

The head arrays 51K, 51C, 51M, and 51Y are liquid dischargers to discharge liquid of the colors black (K), cyan (C), magenta (M), and yellow (Y) onto the continuous medium 10 conveyed along the conveyance guide 59. Note that the number and types of colors are not limited to the above-described four colors of K, C, M, and Y and may be any other suitable number and type.

Figure 2:
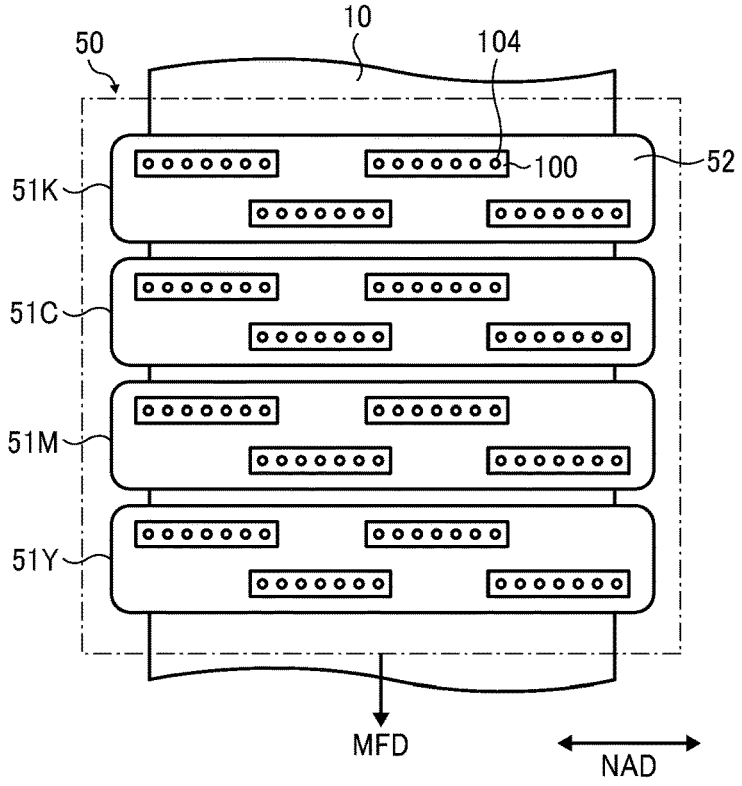
FIG. 2 is a plan view of a head unit of the printer of FIG. 1.

In each head array 51, for example, as illustrated in FIG. 2, a plurality of liquid discharge heads 100 (hereinafter, simply referred to as "heads") is arranged in a staggered manner on a base 52 to form the head array 51. Note that the configuration of the head array 51 is not limited to such a configuration.

[Liquid Discharge Head]

An example of a liquid discharge head according to an embodiment of the present disclosure is described with reference to FIGS. 3 and 4.

Figure 3:
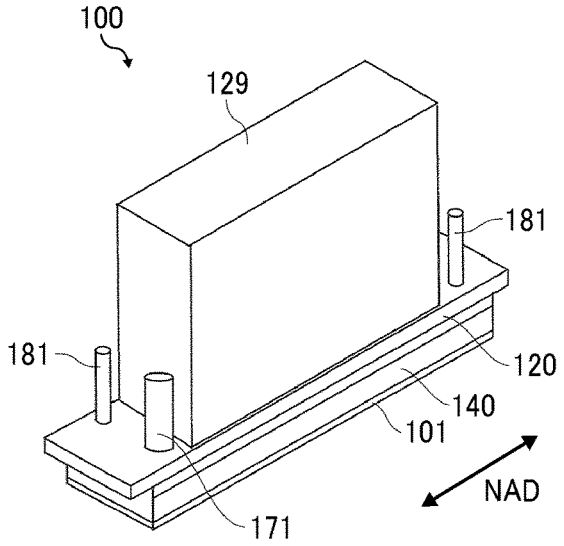
FIG. 3 is an outer perspective view of a head according to the first embodiment.

FIG. 3 is an outer perspective view of the head 100. FIG. 4 is a cross-sectional view of the head 100 in a direction perpendicular to a nozzle array direction in which nozzles 104 are arrayed in a row direction as indicated by arrow NAD in FIG. 3. The nozzle array direction NAD is along a longitudinal direction of an individual chamber 106 described below.

The head 100 includes a nozzle plate 101, a channel substrate 102, and a diaphragm 103 that forms one wall, laminated one on another and bonded to each other. The head 100 includes piezoelectric actuators 111 to displace vibration portions 130 of the diaphragm 103, a common chamber substrate 120 also serving as a frame member of the head 100, and a cover 129. The channel substrate 102 and the diaphragm 103 constitute a channel member 140.

The nozzle plate 101 includes multiple nozzles 104 to discharge liquid.

The channel substrate 102 includes through-holes and grooves that form individual chambers 106, supply-side fluid restrictors 107, and liquid introduction portions 108. The individual chambers 106 communicate with the nozzles 104 via the nozzle communication channels 105, respectively. The supply-side fluid restrictors 107 communicate with the individual chambers 106, respectively. The liquid introduction portions 108 communicate with the supply-side fluid restrictors 107, respectively. The nozzle communication channels 105 communicate with the corresponding nozzles 104 and the individual chambers 106, respectively. The liquid introduction portions 108 communicate with the supply-side common chamber 110 via the opening 109 of the diaphragm 103.

The diaphragm 103 includes deformable vibration portions 130 constituting walls of the individual chambers 106 of the channel substrate 102. In the present embodiment, the diaphragm 103 has a two-layer structure including a first layer consisting of thin portions and facing the channel substrate 102 and a second layer consisting of thick portions. The first layer includes the deformable vibration portions 130 at positions corresponding to the individual chambers 106. Note that the diaphragm 302 is not limited to the two-layer structure and the number of layers may be any other suitable number.

On the opposite side of the individual chamber 106 of the diaphragm 103, there is arranged the piezoelectric actuator 111 including an electromechanical transducer element as a driver (e.g., actuator, pressure generator) to deform the deformable vibration portion 130 of the diaphragm 103.

The piezoelectric actuator 111 includes piezoelectric elements 112 bonded on a base 113. The piezoelectric elements 112 are groove-processed by half-cut dicing so that each piezoelectric elements 112 includes a desired number of pillar-shaped piezoelectric elements 112 that are arranged in certain intervals to have a comb shape.

The piezoelectric element 112 is joined to a convex portion 130*a*, which is a thick portion having an island-like form formed on the vibration portion 130 of the diaphragm 103. In addition, a flexible printed circuit (FPC) 115 is connected to the piezoelectric elements 112.

The common chamber substrate 120 includes a supply-side common chamber 110 and a discharge-side common chamber 150. The supply-side common chamber 110 communicates with supply ports 171. The discharge-side common chamber 150 communicates with the discharge ports 181 (See FIG. 3).

The common chamber substrate 120 includes a first common chamber substrate 121 and a second common chamber substrate 122. The first common chamber substrate 121 is bonded to the diaphragm 103 of the channel member 140. The second common chamber substrate 122 is laminated on and bonded to the first common chamber substrate 121.

The first common chamber substrate 121 includes a downstream common chamber 110A and the discharge-side common chamber 150. The downstream common chamber 110A is part of the supply-side common chamber 110 and is communicable with the liquid introduction portion 108. The discharge-side common chamber 150 communicates with a discharge channel 151. The second common chamber substrate 122 includes an upstream common chamber 110B that is a remaining portion of the supply-side common chamber 110.

The channel substrate 102 includes the discharge channels 151 formed parallel to the surface of the channel substrate 102 and communicated with the individual chambers 106 via the nozzle communication channel 105. The discharge channels 151 communicate with the discharge-side common chamber 150.

In the head 100 thus configured, for example, when a voltage lower than a reference potential (intermediate potential) is applied to the piezoelectric element 112, the piezoelectric element 112 contracts. Accordingly, the vibration portion 130 of the diaphragm 103 is pulled to increase the volume of the individual chamber 106, thus causing liquid to flow into the individual chamber 106. When the voltage applied to the piezoelectric element 112 is raised, the piezoelectric element 112 expands. Accordingly, the vibration portion 130 of the diaphragm 103 deforms in a direction toward the nozzle 104 and the volume of the individual chamber 106 decreases. Thus, liquid in the individual chamber 106 is discharged from the nozzle 104.

Liquid not discharged from the nozzles 104 passes the nozzles 104 and is drained from the discharge channels 151 to the discharge-side common chamber 150 and supplied from the discharge-side common chamber 150 to the supply-side common chamber 110 again through an external circulation route.

Note that the driving method of the head 100 is not limited to the above-described example (i.e., pull-push discharge). For example, pull discharge or push discharge may be performed depending on the drive waveform.

[Liquid Circulation Mechanism]

Next, a liquid circulation system (liquid circulation apparatus 200) in a first embodiment of the present disclosure is described below with reference to FIG. 5.

Figure 5:
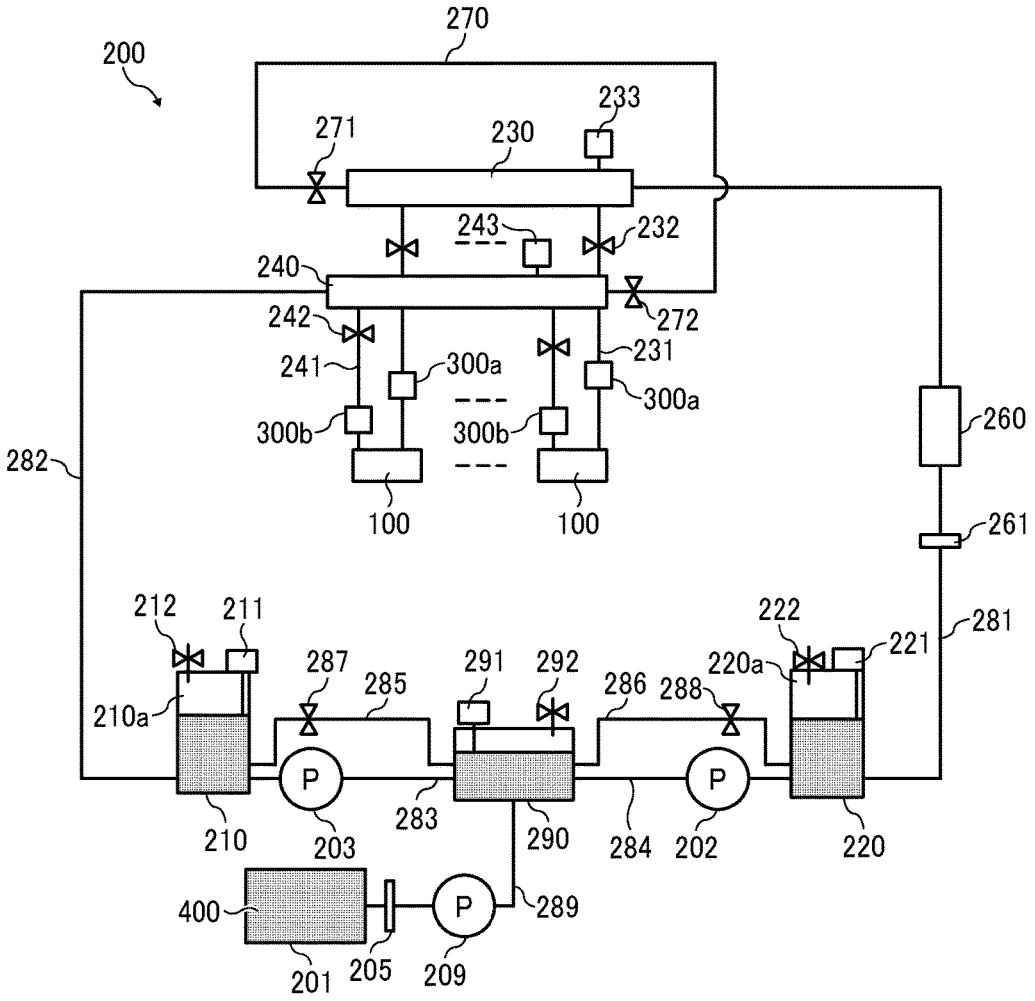
FIG. 5 is a circuit diagram of a liquid circulation apparatus in the first embodiment.

FIG. 5 is a circuit diagram of the liquid circulation apparatus 200 serving as a liquid supply apparatus. A plurality of heads 100 is arranged in a line in the width direction of the continuous medium 10 to circulate the liquid. The liquid 400 is circulatable through each of the plurality of heads 100.

A liquid circulation apparatus 200 includes a main tank 201 (liquid tank), a first sub tank 220 (pressurized tank), a second sub tank 210 (depressurized tank), a third sub tank 290, a first supply pump 202, a second supply pump 203, and a third supply pump 209. The main tank 201 stores liquid 400 to be discharged by the heads 100. The main tanks 201 serve as a liquid storing device. The main tank 201 may be a liquid cartridge detachable to the liquid circulation apparatus 200.

The liquid circulation apparatus 200 further includes a first manifold 230, a second manifold 240, a first head tank 300*a*, a second head tank 300*b*, and a degassing device 260. A plurality of heads 100 communicate with the first manifold 230 and the second manifold 240. The first head tank 300*a* and the second head tank 300*b* are provided for each of the heads 100. The degassing device 260 removes dissolved gas in the liquid 400. Details of the first head tank 300*a* and the second head tank 300*b* (hereinafter referred to as the head tank 300 (buffer tank) when not distinguished) is described below.

The third sub tank 290 is disposed between the first sub tank 220 and the second sub tank 210. The third supply pump 209 supplies the liquid to the third sub tank 290 from the main tank 201 via a liquid channel 289 that includes a filter 205.

The third sub tank 290 includes a liquid detector 291 to detect the surface of the liquid 400 and a solenoid valve 292 that constitutes an air release mechanism to release air inside the third sub tank 290 to the outside.

The third sub tank 290 and the second sub tank 210 are connected by a liquid channel 283. A second supply pump 203 is provided on the liquid channel 283. Further, the third sub tank 290 and the second sub tank 210 are connected by a reverse liquid channel 285. A solenoid valve 287 is provided on the reverse liquid channel 285.

The second sub tank 210 includes a gas chamber 210*a*. Thus, liquid and gas coexist in the second sub tank 210. The second sub tank 210 includes a liquid detector 211 to detect the surface of the liquid 400 and a solenoid valve 212 that constitutes an air release mechanism to release air inside the second sub tank 210 to the outside.

The third sub tank 290 and the first sub tank 220 are connected by a liquid channel 284. A first supply pump 202 is provided on the liquid channel 284. Further, the third sub tank 290 and the first sub tank 220 are connected by a reverse liquid channel 286. A solenoid valve 288 is provided on the reverse liquid channel 286.

The first sub tank 220 includes a gas chamber 220*a*. Thus, liquid and gas coexist in the first sub tank 220. The first sub tank 220 includes a liquid detector 221 to detect the surface of the liquid 400 and a solenoid valve 222 that constitutes an air release mechanism to release air inside the first sub tank 220 to the outside.

The first sub tank 220 is connected to the first manifold 230 via the liquid channel 281 that includes a degassing device 260 and a filter 261.

The first manifold 230 is connected to a supply port 171 (see FIG. 3) of the head 100 via the supply channel 231. The supply channel 231 is connected to the supply port 171 (see FIG. 3) of the head 100 via the first head tank 300*a*. A solenoid valve 232 is provided upstream from the first head tank 300*a* on the supply channel 231 to open and close the supply channel 231. The solenoid valve 232 is provided according to the number of the heads 100, and can be opened and closed individually. A pressure sensor 233 is provided on the first manifold 230.

The second sub tank 210 is connected to the second manifold 240 via the liquid channel 282.

The second manifold 240 is connected to a discharge port 181 (see FIG. 3) of the head 100 via a discharge channel 241. The discharge channel 241 is connected to the discharge port 181 (see FIG. 3) of the head 100 via the second head tank 300*b*. A solenoid valve 242 is provided on a downstream of the second head tank 300*b* on the discharge channel 241 to open and close the discharge channel 241. The solenoid valve 242 is provided according to the number of the heads 100, and can be opened and closed individually. A pressure sensor 243 is provided on the second manifold 240.

Further, a bypass channel 270 is provided to connect the first manifold 230 and the second manifold 240. A solenoid valve 271 is provided on the first manifold 230 side of the bypass channel 270, and a solenoid valve 272 is provided on the second manifold 240 side of the bypass channel 270.

Here, a circulation channel is configured as a route from the third sub tank 290 and returned to the third sub tank 290 via the liquid channel 284, the first sub tank 220, the liquid channel 281, the degassing device 260, the first manifold 230, the head 100, the second manifold 240, and the second sub tank 210. Hereinafter, a direction of liquid flow in the circulation channel is referred to as "a circulation direction".

Thus, the liquid circulation apparatus 200 includes a liquid channel 281, 282, 283, 284, and 289, the supply channel 231, and the discharge channel 241 that configures the circulation channel through which the liquid 400 is circulated via the heads 100.

The first manifold 230 is disposed upstream of the plurality of first head tanks 300*a* in a circulation direction of the liquid 400, and the second manifold 240 is disposed downstream of the plurality of second head tanks 300*b* in a circulation direction of the liquid 400.

Further, the solenoid valves 232, 242, 271, and 272 configure a switch between a first route and a second route. The bypass channel 270 configures a part of the circulation channel in the first route by shutting off a channel between the head 100 and the circulation channel with the switch (solenoid valves 232, 242, 271, and 272). The head 100 configures a part of the circulation channel in the second route by shutting off a channel between the bypass channel 270 and the circulation channel with the switch (solenoid valves 232, 242, 271, and 272).

That is, the first route is configured by closing the solenoid valves 232 and 242 and opening the solenoid valve 271 and 272. The bypass channel 270 becomes a part of the circulation channel and the heads 100 do not become a part of the circulation channel in the first route.

Further, the second route is configured by opening the solenoid valve 232 and 242 and closing the solenoid valve 271 and 272. The heads 100 become a part of the circulation channel and the bypass channel 270 does not become a part of the circulation channel in the second route.

Further, the first sub tank 220, the second sub tank 210, the first supply pump 202, and the second supply pump 203 configures a pressure generator to generate a pressure for circulating liquid 400 in the circulation channel.

Supply and circulation of liquid 400 is described below.

(1) Liquid flow from the main tank 201 to the third sub tank 290. When the liquid detector 291 detects liquid shortage in the third sub tank 290, the third supply pump 209 is driven to supply the liquid 400 to the third sub tank 290 from the main tank 201 via the liquid channel 289 until the liquid detector 291 detects that the liquid level in the third sub tank 290 is full.

(2) Liquid flow from the third sub tank 290 to the first sub tank 220. The liquid 400 is supplied from the third sub tank 290 to the first sub tank 220 via the liquid channel 284 by driving the first supply pump 202.

(3) Liquid flow from the second sub tank 210 to the third sub tank 290. The liquid 400 is supplied from the second sub tank 210 to the third sub tank 290 via the liquid channel 283 by driving the second supply pump 203.

(4) Liquid flow from the first sub tank 220 to the head 100 and from the head 100 to the second sub tank 210. The liquid 400 is supplied to the first sub tank 220 by driving the first supply pump 202 until the pressure sensor 233 detects that pressure in the first manifold 230 becomes the target pressure (positive pressure, for example). The liquid 400 is supplied to the third sub tank 290 by driving the second supply pump 203 until the pressure sensor 243 detects that pressure in the second manifold 240 becomes the target pressure (negative pressure, for example).

Thus, a differential pressure is generated between the first sub tank 220 and the second sub tank 210, by which the liquid 400 is circulatable from the first sub tank 220 to the second sub tank 210 via the liquid channel 281, the filter 261, the degassing device 260, the first manifold 230, a plurality of the supply channels 231, a plurality of first head tanks 300*a*, 300*c*, and 300*e*, a plurality of heads 100, a plurality of discharge channels 241, a plurality of the second head tanks 300*b*, 300*d*, and 300*f*, the second manifold 240, and the liquid channel 282. At this time, the solenoid valves 232 and 242 are opened and the solenoid valves 271 and 272 are closed.

When the first supply pump 202 and the second supply pump 203 are driven to generate a pressure differential in a state in which the solenoid valves 232 and 242 are closed and the solenoid valves 271 and 272 are opened, according to this differential pressure, the liquid 400 is circulatable from the first sub tank 220 to the second sub tank 210 via the liquid channel 281, the filter 261, the degassing device 260, the first manifold 230, a bypass channel 270, a second manifold 240, and the liquid channel 282.

The liquid detectors 211, 221, and 291 provided to each sub tanks may be a detector using a float, a detector using at least two electrodes to detect the liquid 400 according to a voltage output, or a laser detector.

Further, each of the sub tanks is provided with solenoid valves 212, 222, 292 as an air release mechanism, respectively, and by controlling the solenoid valves 212, 222, 292, it is possible to communicate each sub tank with the outside.

Next, the role of the gas chamber 220*a* of the first sub tank 220 and the gas chamber 210*a* of the second sub tank 210 are described below.

In the gas chamber 220*a* and the gas chamber 210*a*, the surface of the liquid 400 is in contact with air, for example. When compressed air is generated in the first sub tank 220 and a reduced pressure state of air is generated in the second sub tank 210, a pressure can be stored in the first sub tank 220 and the second sub tank since the gas has compressibility. The air in the first sub tank 220 and the second sub tank 210 is considered to be a capacitor component or a compliance (elastic component) when the first sub tank 220 and the second sub tank 210 are represented as an equivalent electric circuit.

When the liquid circulation apparatus 200 drives the first supply pump 202 and the second supply pump 203, a pressure change (pulsation) occurs. The first supply pump 202 communicates with first sub tank 220 and the third sub tank 290. The second supply pump 203 communicates with second sub tank 210 and the third sub tank 290. When this pressure change transmits to a meniscus in the nozzle 104 through the liquid channel, the pressure change may cause liquid to leak from the nozzles 104 or bubbles to enter into the nozzles 104.

Thus, a compliance (elastic component) is necessary to suppress the pressure change (pulsation). Generally, air has a compressive characteristic and the air thus becomes a compliance component. Accordingly, the liquid circulation apparatus 200 can suppress the pressure change (pulsation) by including the gas chambers 220*a* and 210*a*.

[Controller]

A controller 500 of the above liquid circulation apparatus 200 is described in detail below with reference to FIG. 6.

Figure 6:
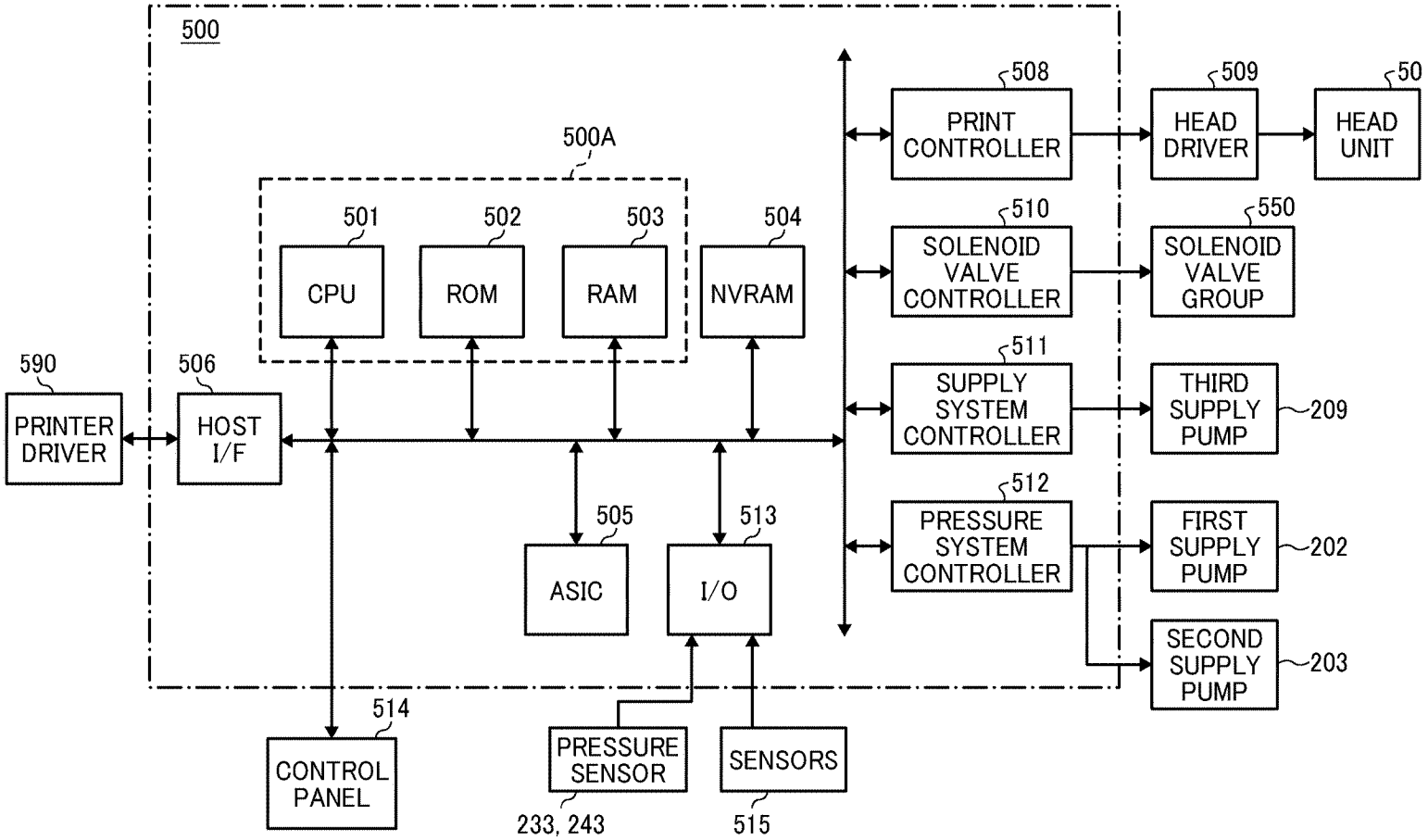
FIG. 6 is a functional block chart of a controller of the printer of the first embodiment.

FIG. 6 is a functional block chart of the controller 500. The controller 500 includes a main controller 500A including a central processing unit (CPU) 501, a read only memory (ROM) 502, and a random access memory (RAM) 503. The CPU 501 controls the overall apparatus. The ROM 502 stores fixed data including various programs to be executed by the CPU 501. The RAM 503 temporarily store data such as image data.

The controller 500 includes a rewritable nonvolatile random access memory (NVRAM) 504 to retain data during the liquid circulation apparatus 200 is powered off. The controller 500 includes an application specific integrated circuit (ASIC) 505 to perform image processing, such as various types of signal processing and sorting, on image data and to process input/output signals to control the liquid circulation apparatus 200 entirely. The controller further exchanges data with the printer driver 590 via the host interface (I/F) 506.

The controller 500 includes a print controller 508 and a driver integrated circuit (hereinafter, head driver) 509. The print controller 508 includes a data transmitter, a drive signal generator, and a bias voltage output unit to drive and control each of the heads 100 of the first head unit 50. The head driver 509 drives each of the heads 100.

The controller 500 includes and a solenoid valve controller 510 to control a solenoid valve group 550. The solenoid valve group 550 includes solenoid valves 232, 242, 271, and 272, and solenoid valves 212, 222, 292, 287, and 288. The solenoid valve controller 510 control driving of the solenoid valves 232, 242, 271, and 272, and the solenoid valves 212, 222, 292, 287, and 288.

The controller 500 includes a supply system controller 511 to control driving of a third supply pump 209.

The controller 500 includes a pressure system controller 512 to control driving of a first supply pump 202 and a second supply pump 203.

The controller 500 further includes an input/output (I/O) unit 513. The I/O unit 513 processes various sensor data and acquires detection results from the pressure sensors 233 and 243 and information from various types of sensors 515 mounted in the liquid circulation apparatus 200. The I/O unit 513 also extracts data for controlling the liquid circulation apparatus 200, and uses extracted data to control the print controller 508, the solenoid valve controller 510, the supply system controller 511, and the pressure system controller 512.

A control panel 514 used to input and display information necessary to the liquid circulation apparatus 200 is connected to the controller 500.

[Head Tank]

Next, the first head tanks 300*a*, 300*c*, and 300*e* and the second head tanks 300*b*, 300*d*, and 300*f* connected to the head 100 are described below with reference to FIGS. 7A, 7B. In the following embodiments, the liquid circulation apparatus 200 including both the first head tanks 300*a*, 300*c*, and 300*e* and the second head tanks 300*b*, 300*d*, and 300*f* is described as an example. However, the liquid circulation apparatus 200 may include one of the first head tanks 300*a*, 300*c*, and 300*e* and the second head tanks 300*b*, 300*d*, and 300*f*.

FIGS. 7A and 7B are schematic views of the head tank 300 of the liquid circulation apparatus 200 according the present disclosure. FIG. 7A is a front view of the head tank 300. FIG. 7B is a cross-sectional view along a line A-A in FIG. 7A. As illustrated in FIG. 7, the head tank 300 includes a liquid port 306*a* and a liquid port 306*b*. The liquid port 306*a* is connected to the first manifold 230 or the second manifold 240 via a tube. A liquid port 306*b* is connected to the head 100 via a tube. The liquid ports 306*a* of the first head tanks 300*a*, 300*c*, and 300*e* are connected to the first manifold 230. The liquid ports 306*a* of the second head tanks 300*b*, 300*d*, and 300*f* are connected to the second manifold 240. The head tank 300 include a liquid chamber 304 formed with a diaphragm 302 (flexible member), one surface of which is made of a flexible material.

The space outside the diaphragm 302 is covered with a casing 303 to form a gas chamber 305. The casing 303 includes two air ports 307*a* and 307*b* communicating with the gas chamber 305. The air ports 307*a* and 307*b* are referred to collectively as an "air port 307" when the air ports 307*a* and 307*b* need not be distinguished. In FIG. 7B, the diaphragm 302 indicated by the solid line illustrate a state in which the liquid chamber 304 is expanded and convex toward the gas chamber 305 side. The diaphragm 302 indicated by a broken line illustrate a state in which the liquid chamber 304 contracts and is recessed toward the liquid chamber 304 side.

FIG. 8 is a circuit diagram of the liquid circulation apparatus 200 according to the present disclosure, illustrating an exploded view of a part of the liquid circulation apparatus 200 in FIG. 5. FIG. 8 illustrates a liquid circulation path from the first manifold 230 to the head 100 and a liquid circulation path from the head 100 to the second manifold 240. FIG. 8 illustrates an example of the liquid circulation apparatus 200 including the three head 100. However, the number of the heads 100 is not limited to three, and any number of the heads 100 may be applied to the present disclosure. In FIG. 8, three of the first head tanks 300*a*, 300*c*, and 300*e* and three of the second head tanks 300*b*, 300*d*, and 300*f* are illustrated as an example. However, the present disclosure is not limited to the embodiment as illustrated in FIG. 8, and liquid circulation apparatus 200 may include more than three first head tanks and second head tanks, respectively.

Figure 4:
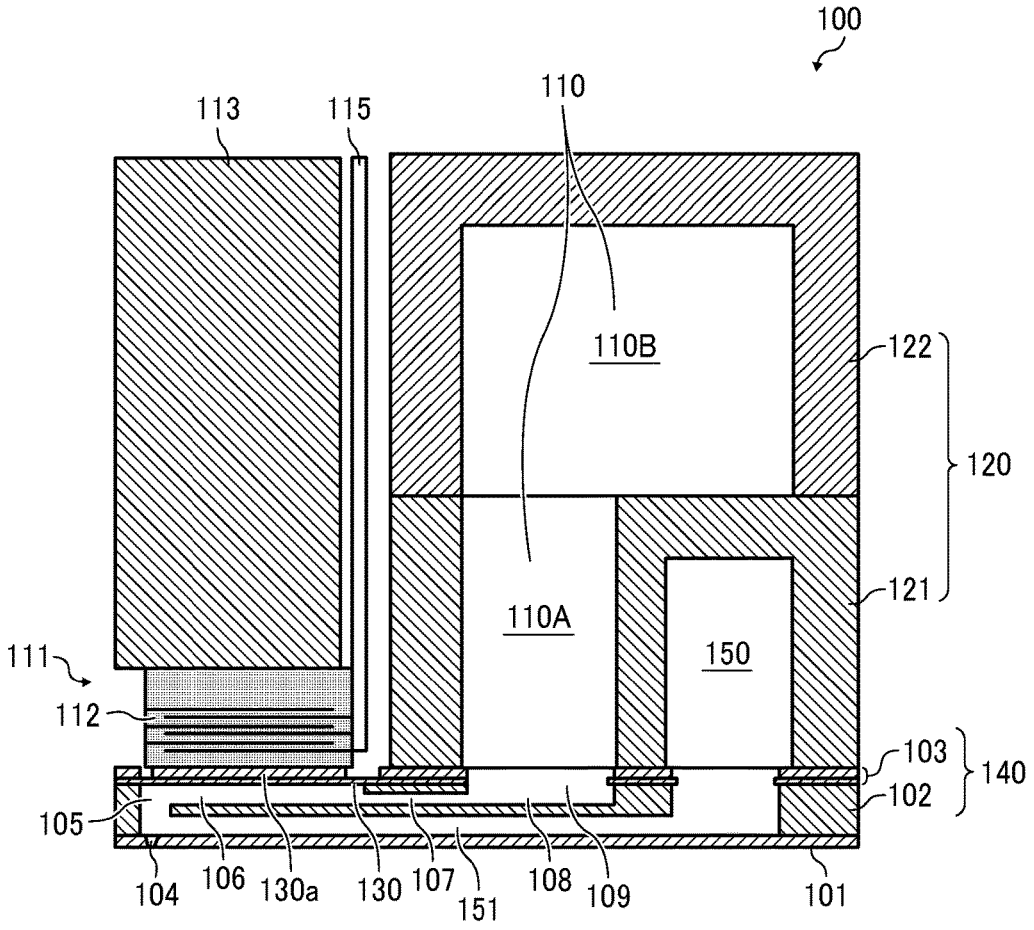
FIG. 4 is a cross-sectional view of the head in a direction perpendicular to a nozzle array direction (NAD) in which nozzles are arrayed in a row direction (a longitudinal direction of an individual chamber)

In FIG. 8, the liquid 400 is circulatable through the heads 100 as illustrated in FIG. 4. The first head tank 300*a* is connected to the supply-side common chamber 110, and the second head tank 300*b* is connected to the discharge-side common chamber 150 (see FIG. 4). Further, the first head tank 300*a* is connected to the first manifold 230, and the second head tank 300*b* is connected to the second manifold 240.

In the liquid circulation path as illustrated in FIG. 8, the liquid 400 flows from the first manifold 230 to the second manifold 240 via the first head tank 300*a* (or the first head tank 300*c* or 300*e*), the head 100, and the second head tank 300*b* (or the second head tank 300*c* or 3000 when the head 100 discharges the liquid 400 to form a pattern on the continuous medium 10.

The number of heads is 3 in the present disclosure as illustrated in FIG. 8. The first manifold 230 is connected to three of the first head tanks 300*a*, 300*c* and 300*e*. The second manifold 240 is connected to the second head tanks 300*b*, 300*d*, and 300*f* Thus, the liquid circulation apparatus 200 includes six numbers of the head tanks (first head tanks 300*a*, 300*c*, and 300*e*, and second head tanks 300*b*, 300*d*, and 300*f*) in total.

The air ports 307 of each of the three first head tanks 300*a*, 300*c*, and 300*e* are connected by a connection path 602 such as a tube as indicated by dashed lines in FIG. 8. As illustrated in FIG. 8, the air port 307*a* of the first head tank 300*a* and the air port 307*b* of the first head tank 300*c* are connected with the connection path 602. Furthermore, the air port 307*a* of the first head tank 300*c* and the air port 307*b* of the first head tank 300*e* are connected with the connection path 602. The air port 307*b* of the first head tank 300*a* on the right side is connected to a first air release valve 320. The air port 307*a* of the first head tank 300*e* on the left side is sealed by a cap 321. As a result, all three first head tanks 300*a*, 300*c*, and 300*e* are communicated with each other by the connection path 602. Thus, the three first head tanks 300*a*, 300*c*, and 300*e* have a common closed space when the first air release valve 320 is closed.

Similarly, the air ports 307 of each of the three second head tanks 300*b*, 300*d*, and 300*f* are connected by a connection path 602 as indicated by dashed lines in FIG. 8. As illustrated in FIG. 8, the air port 307*a* of the second head tank 300*b* and the air port 307*b* of the second head tank 300*d* are connected with the connection path 602. Furthermore, the air port 307*a* of the second head tank 300*d* and the air port 307*b* of the second head tank 300*f* are connected with the connection path 602. The air port 307*b* of the second head tank 300*b* is connected to a second air release valve 330. The air port 307*a* of the second head tank 300*f* is sealed by a cap 331. As a result, all three second head tanks 300*b*, 300*d*, and 300*f* are communicate with each other by the connection path 602. Thus, the three of the second head tanks 300*b*, 300*d*, and 300*f* have a common closed space when the second air release valve 330 is closed.

A liquid discharge operation of the liquid circulation apparatus 200 and an effect of the head tank 300 in the present disclosure are described with reference to FIGS. 5 and 8.

First, the first air release valve 320 and the second air release valve 330 are temporarily opened to release the gas chambers 305 of all the head tanks 300 to the atmosphere in a state in which the first supply pump 202 and the second supply pump 203 are stopped (hereinafter referred to as a "stopped state") in the liquid circulation apparatus 200.

Thus, at least one of the gas chamber 305 of the plurality of first head tanks 300*a* and at least one of the gas chamber 305 of the plurality of second head tanks 300*b* are communicable with atmosphere via the first air release valve 320 and the second air release valve 330.

Next, the first air release valve 320 and the second air release valve 330 are closed to close the gas chambers 305 of the first head tanks 300*a*, 300*c*, and 300*e* and the second head tanks 300*b*, 300*d*, and 300*f* to form an airtight space. Then, the first supply pump 202 and the second supply pump 203 are driven to circulate the liquid 400 in the liquid circulation apparatus 200.

As described above, flow rates of the first supply pump 202 and the second supply pump 203 are controlled based on the readings from the pressure sensors 233 and 243. Then, as illustrated in FIG. 5, the liquid 400 is circulated from the third sub tank 290 and returned to the third sub tank 290 via the liquid channel 284, the first sub tank 220, the liquid channel 281, the degassing device 260, the first manifold 230, the first head tank 300*a*, the head 100, the second head tank 300*b*, the second manifold 240, the liquid channel 282, the second sub tank 210, the liquid channel 283, and the third sub tank 290.

Through the circulation process of the liquid 400 described above, the liquid 400 is degassed by the degassing device 260 and does not come in contact with the air before the liquid 400 is supplied to the head 100. Thus, the liquid circulation apparatus 200 can supply the liquid 400 satisfactorily degassed to the head 100 while preventing air from being dissolved in the liquid 400 to decrease a degassing degree before the liquid 400 is supplied to the head 100.

The pressure of the liquid 400 in the head 100 is set to a negative pressure of, for example, about −0.5 kPa in the vicinity of the nozzle 104. The negative pressure instantly increases by discharging the liquid 400 by the head 100, and the liquid 400 is refilled in the individual chamber 106 of the head 100 to return to the original pressure. It takes time to refill the head 100 when a resistance of the liquid channels 281, 282,283, and 284 is great because the liquid channels 281, 282, 283, and 284 are long. Thus, a delay occurs between timing of refilling the liquid 400 to the head 100 and timing of discharging the liquid 400 by the head 100. Therefore, increase in the negative pressure may hinder normal discharging process of the liquid 400 or cause a discharge failure of the liquid 400. Even if a discharge failure does not occur, images having high quality may not be obtained when the pressure fluctuation in the head 100 increases due to discharging and refilling process that cause a fluctuation in a volume and a speed of the discharged droplets.

For example, a liquid circulation apparatus 200 may include two tanks each including a diaphragm to have a pressure buffering function. The two tanks generate a circulation flow. This two tanks configuration has a long distance to connect between the head and tanks. Further, the pressure fluctuation of the plurality of heads 100 is damped by one tank. Thus, this two tanks configuration may not satisfactorily dampen the pressure fluctuation due to a liquid discharge process.

Conversely, the liquid circulation apparatus 200 according to the present disclosure includes the head tank 300, the volume of which is variable by the diaphragm 302, in the vicinity of the head 100.

Thus, the liquid circulation apparatus 200 can instantaneously dampen the fluctuation in the pressure caused by discharging the liquid 400 from the head 100. Further, the liquid circulation apparatus 200 can appropriately resupply the liquid 400 to the head 100 and stably maintain the pressure in the individual chamber 106 in the head 100 even when the head 100 discharges the liquid 400 with high frequency, a liquid consumption of which is large.

Further, a pressure difference between the first sub tank 220 and the second sub tank 210 has to be increased when the liquid 400 is circulated in the liquid circulation apparatus 200 including the head 100 since a fluid resistance of the individual chamber 106 and the discharge channel 151 inside the head 100 is great. Thus, the first sub tank 220 is pressurized, and the liquid chamber 304 of the first head tank 300*a* expands by a displacement of the diaphragm 302 as indicated by the solid line in FIG. 7B. Conversely, the second sub tank 210 is depressurized, and the liquid chamber 304 of the second head tank 300*b* contracts by a displacement of the diaphragm 302 as indicated by the dashed line in FIG. 7B.

At this time, the greater the pressure of the liquid 400 is, the more the diaphragm 302 deforms. The gas chamber 305 is hermetically sealed in the head tank 300 according to the present embodiment. The gas chamber 305 is a space outside the diaphragm 302. When the diaphragm 302 is pushed by the pressure of the liquid 400, the air in the gas chamber 305 pushes the diaphragm 302 back. Thus, an excessive deformation of the diaphragm 302 can be prevented even when the pressure of the liquid 400 is high and large pressure is applied to the diaphragm 302. Thus, the liquid circulation apparatus 200 can improve the durability of the diaphragm 302.

Further, the gas chambers 305 of the plurality of head tanks 300 communicate with each other in the present disclosure. Thus, the head tank 300 of one head 100 can utilize the gas chambers 305 of the other head tanks 300 of the other heads 100 that discharges the liquid 400 with low frequency. Thus, the head tank 300 provides improved pressure damping performance.

Further, the head tanks 300*a* and 300*b* of the present embodiment are respectively connected to the first and second air release valves 320 and 330, and the gas chambers 305 of the head tanks 300*a* and 300*b* are communicable with the outside. Thus, the head tanks 300*a* and 300*b* can reset an amount of air in each of the gas chambers 305 of the head tanks 300*a* and 300*b*. At the same time, the gas chambers 305 can be release to the atmosphere when the liquid circulation apparatus 200 stops operation or the like. Thus, the head tank 300 can prevent problems such as a pressure fluctuation caused by a change in an ambient temperature or the like, or liquid leaks from the head 100 caused by an expansion of the gas chamber 305 due to a temperature rise that increases a pressure of the liquid 400 in the liquid chamber 304.

As described above, the head tank 300 of the present embodiment can reduce the pressure fluctuation in the head 100 generated during the liquid discharge operation of the head 100 and stably maintain the pressure damping performance for a long period.

[Second Embodiment]

Next, the liquid circulation apparatus 200 according to a second embodiment of the present disclosure is described below. Redundant descriptions of the same or similar components and configurations are omitted below.

Figure 9A:
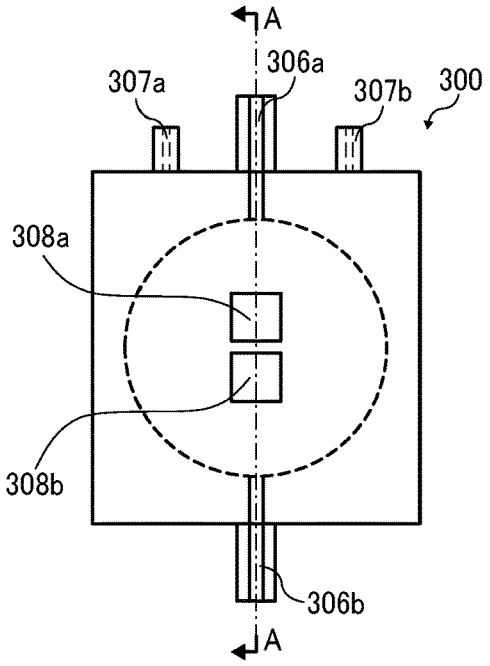
FIGS. 9A and 9B are a front view and a cross sectional view of a head tank, respectively, according to a second embodiment.
Figure 9B:
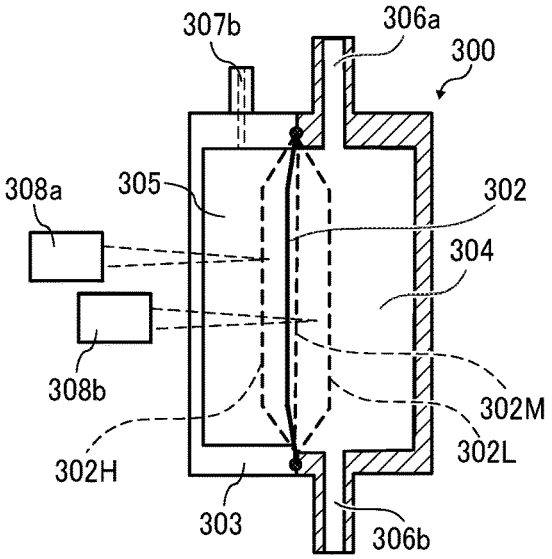

FIGS. 9A and 9B are schematic views of the head tank 300 of the liquid circulation apparatus 200 according the second embodiment. FIG. 9A is a front view of the head tank 300. FIG. 9B is a cross-sectional view along a line A-A in FIG. 9A.

The head tank 300 according to the second embodiment includes the casing 303 formed of a transparent resin and photosensors 308*a* and 308*b* disposed at positions facing the casing 303. The photosensors 308*a* and 308*b* serve as displacement detectors to detect a displacement of the diaphragm 302. The position of the diaphragm 302 inside the head tank 300 can be detected by these two photosensors 308*a* and 308*b*.

When liquid 400 is discharged from the head 100, the first supply pump 202 and the second supply pump 203 are controlled to circulate the liquid 400 in the head 100, to resupply the liquid 400 to the head 100, and to keep the pressure in the head 100 as constant as possible. However, a delay may occur in refilling the liquid 400 from the first head tank 300*a*, 300*c*, and 300*e* to the head 100 when the liquid consumption of the head 100 is fast.

The diaphragm 302 of the head tank 300 preferably deforms in both of expanding the volume of the liquid chamber 304 as well as contracting the volume of the liquid chamber 304 without pressure change to prevent problems. The problems incurred by the delay include such as insufficient liquid supply from the head tank 300 to the head 100 and excessive liquid supply from the head tank 300 to the head 100.

The diaphragm 302 can favorably prevent the pressure fluctuation in a state indicated by the diaphragm 302M in FIG. 9B in which the liquid 400 flows between the head tank 300 and the head 100.

Thus, the head tank 300 according to the second embodiment can detect whether the diaphragm 302 is at an ideal position by two of the photosensors 308*a* and 308*b*.

Figure 10A:
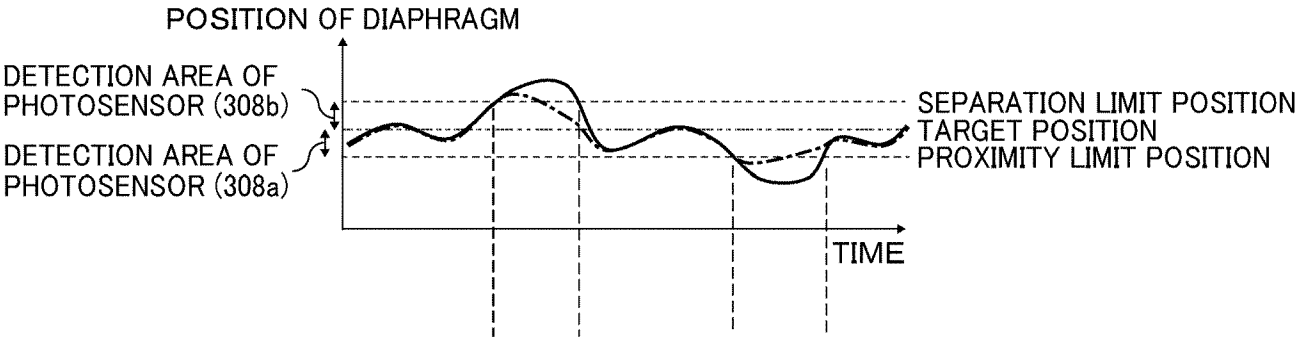
FIGS. 10A and 10B are graphs illustrating a deformation of the diaphragm and a detection area of the photosensors, and a timing chart during driving an air pump.
Figure 10B:
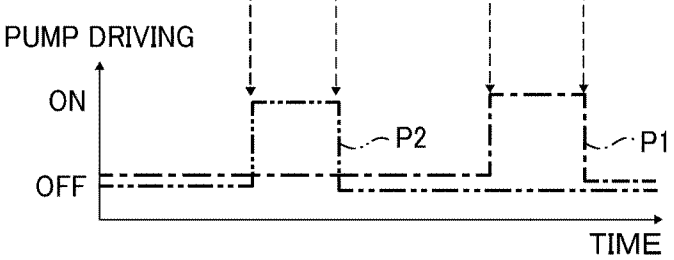

FIG. 10A is a graph illustrating a deformation of the diaphragm 302 and a detection area of the photosensors. FIG. 10B is a timing chart during driving an air pump.

As illustrated in FIG. 9B, the photosensors 308*a* and 308*b* are reflection-type photosensors, and are disposed at positions at different distances from the diaphragm 302 in a direction perpendicular to a plane of the diaphragm 302. Thus, as illustrated in FIG. 10A, the photosensor 308*a* may turn ON when the diaphragm 302 is disposed in a region from a vicinity of the target position to a proximity limit position (a position of the diaphragm 302H in FIG. 9B). The photosensor 308*b* may turn ON when the diaphragm 302 is disposed in a region from a vicinity of the target position to a separation limit position (a position of the diaphragm 302L in FIG. 9B).

At this time, the position where both of the photosensors 308*a* and 308*b* turn ON becomes a target position of the diaphragm 302. Thus, when one of the photosensors 308*a* or 308*b* is OFF, the position of the diaphragm 302 may be adjusted by driving an air pump to supply air into or remove air from the gas chamber 305 of the head tank 300.

Figure 11:
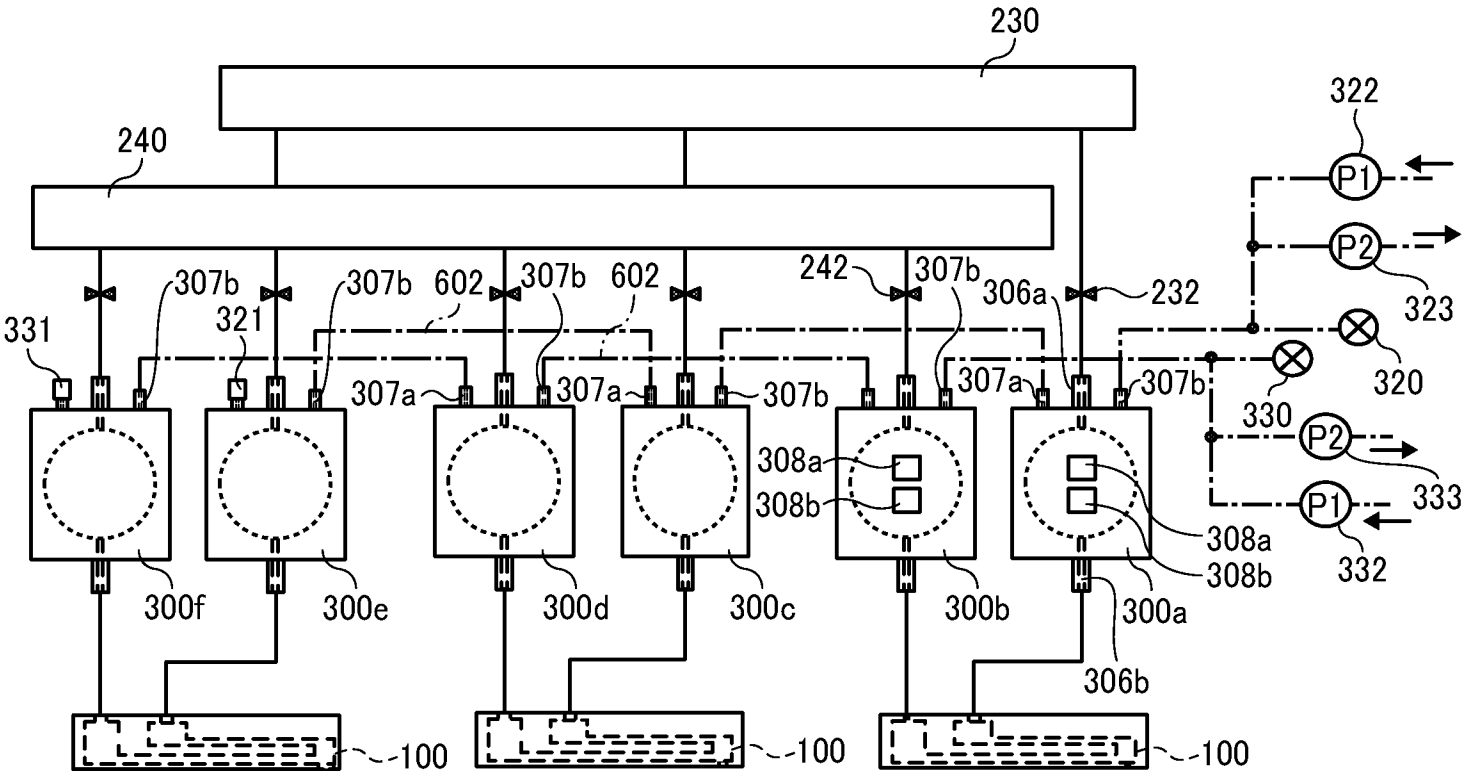
FIG. 11 is an exploded circuit diagram of the liquid circulation apparatus according to the second embodiment.

FIG. 11 is a circuit diagram of the liquid circulation apparatus 200 according to a second embodiment of the present disclosure. FIG. 11 is an exploded view of a part of the liquid circulation apparatus 200 in FIG. 5. FIG. 11 illustrates a liquid circulation path from the first manifold 230 to the head 100 and a liquid circulation path from the head 100 to the second manifold 240. The number of heads is three in the present disclosure as illustrated in FIG. 8. The first manifold 230 is connected to three of the first head tanks 300*a*, 300*c* and 300*e*. The second manifold 240 is connected to three of the second head tanks 300*b*, 300*d*, and 300*f*. Thus, the liquid circulation apparatus 200 includes six numbers of the head tanks (first head tanks 300*a*, 300*c*, and 300*e*, and second head tanks 300*b*, 300*d*, and 300*f*) in total.

In FIG. 11, three of the first head tanks 300*a*, 300*c*, and 300*e* and three of the second head tanks 300*b*, 300*d*, and 300*f* are illustrated as an example as in FIG. 8. However, the present disclosure is not limited to the embodiment as illustrated in FIG. 11, and liquid circulation apparatus 200 may include more than three first head tanks and second head tanks, respectively.

In the liquid circulation apparatus 200 as illustrated in FIG. 11, one of the head tanks 300*a*, 300*c*, and 300*e* (head tank 300*a* in FIG. 11) includes the photosensors 308*a* and 308*b*. Further, one of the head tanks 300*b*, 300*d*, and 300*f* (head tank 300*b* in FIG. 11) includes the photosensors 308*a* and 308*b*. Remaining of the other four head tanks 300 (head tanks 300*c*, 300*d*, 300*e*, and 300*f* in FIG. 11) do not include the photosensors 308*a* and 308*b*.

As in the first embodiment (see FIG. 8), all three first head tanks 300*a*, 300*c*, and 300*e* communicate with each other via a connection path 602. The air port 307*b* of the first head tank 300*a* is connected to the first air release valve 320. Further, the air port 307*a* of the first head tank 300*e* is sealed by the cap 321. Thus, the three first head tanks 300*a*, 300*c*, and 300*e* have a common closed space when the first air release valve 320 is closed.

Further, all three second head tanks 300*b*, 300*d*, 300*f* communicate with each other via a connection path 602. The air port 307*b* of the second head tank 300*b* is connected to the second air release valve 330. Further, the air port 307*a* of the second head tank 300*f* is sealed with the cap 331. Thus, the three second head tanks 300*b*, 300*d*, and 300*f* have a common closed space when the second air release valve 330 is closed.

A part of tubing communicating with the gas chamber 305 of the first head tank 300*a* is bifurcated to be connected to a first air intake pump 322 (P1) and a first air exhaustion pump 323 (P2). When the first air intake pump 322 (P1) is driven, outside air is sent to the gas chamber 305 of the first head tank 300*a*. When the first air exhaustion pump 323 (P2) is driven, the first air exhaustion pump 323 vacuums the air from the gas chamber 305 of the first head tank 300*a*.

Thus, the first air intake pump 322 (P1) and the first air exhaustion pump 323 (P2) are connected to the gas chamber 305 of the at least one of the plurality of first head tanks 300*a* and the at least one of the plurality of second head tanks 300*b* to take air into and discharge air from the gas chamber 305.

A part of tubing communicating with the gas chamber 305 of the second head tank 300*b* is bifurcated to be connected to a second air intake pump 332 (P1) and a second air exhaustion pump 333 (P2). When the second air intake pump 332 (P1) is driven, outside air is sent to the gas chamber 305 of the second head tank 300*b*. When the second air exhaustion pump 333 is driven, the second air exhaustion pump 333 vacuums the air from the gas chamber 305 of the second head tank 300*b*.

Thus, the first air intake pump 322 (P1) the first air exhaustion pump 323 an air pump is connected to the gas chamber of the at least one of the plurality of first head tanks 300*a*, 300*c*, and 300*e* and the at least one of the plurality of second head tanks 300*b*, 300*d*, and 300*f* to take air into and discharge air from the gas chamber.

An operation of the liquid circulation apparatus 200 according to the second embodiment is described below with reference to FIGS. 9A and 9B to FIG. 11.

In the stopped state, the diaphragms 302 of the first head tank 300*a* and the second head tank 300*b* are in the vicinity of the position as indicated by the diaphragm 302M in FIG. 9B. The liquid circulation apparatus 200 includes three of the first head tanks 300*a*, 300*c*, and 300*e*, and three of the second head tanks 300*b*, 300*d*, and 300*f* The liquid chambers 304 and the gas chambers 305 communicate with each other. Thus, a position of the diaphragm 302 of respective head tanks 300*a* through 300*f* is substantially the same position.

Then, the first supply pump 202 and the second supply pump 203 are driven to circulate the liquid 400 in the liquid circulation apparatus 200. Further, the heads 100 discharges the liquid 400 circulated in the liquid circulation apparatus 200. The liquid circulation apparatus 200 controls the first supply pump 202 and the second supply pump 203 (and the third supply pump 209 if necessary) to resupply the liquid 400 discharged from each head 100.

If the controller 500 of the liquid circulation apparatus 200 does not control the first air intake pump 322 (P1), the second air intake pump 332 (P1), the first air exhaustion pump 323 (P2), and the second air exhaustion pump 333, a delay may occur between liquid supply to the head 100 by the above-described first air intake pump 322 (P1), the second air intake pump 332 (P1), the first air exhaustion pump 323 (P2), and the second air exhaustion pump 333 (P2) and a liquid consumption due to liquid discharge by the head 100 as described above. Thus, as illustrated by solid line in FIG. 10A, the diaphragm 302 greatly expands or contracts.

Such a large fluctuation of the diaphragm 302 may stretch the diaphragm 302 taut to reduce a compliance of the liquid chamber 304. Thus, an effect of damping the pressure fluctuation of the diaphragm 302 may be lowered.

Conversely, the head tank 300 according to the second embodiment detects the position of the diaphragm 302 by the photosensors 308*a* and 308*b*. Thus, as illustrated in FIG. 10B, the controller 500 drives the first air exhaustion pump 323 (P2) and the second air exhaustion pump 333 (P2) to vacuum the air from the gas chamber 305 when the photosensor 308*b* detects that the diaphragm 302 is at the separation limit position indicated by 302L as illustrated in FIGS. 9B and 10A.

Conversely, as illustrated in FIG. 10B, the controller 500 drives the first air intake pump 322 (P1) and the second air intake pump 332 (P1) to send the air to the gas chamber 305 when the photosensor 308*a* detects that the diaphragm 302 is at the proximity limit position indicated by 302H as illustrated in FIGS. 9B and 10A.

Thus, the controller 500 can control the position of the diaphragm 302 to be maintained in the vicinity of the target position as indicated by the dashed line in FIG. 10A.

The liquid circulation apparatus 200 according to the second embodiment includes the photosensors 308*a* and 308*b* that detect the displacement of the diaphragm 302 and described first air intake pump 322 (P1), the second air intake pump 332 (P1), the first air exhaustion pump 323 (P2), and the second air exhaustion pump 333 (P2) connected to the gas chamber 305 of the head tanks 300 that enables to send and vacuum air to and from the gas chamber 305. Thus, the liquid circulation apparatus 200 can maintain the compliance of the head tank 300 to be large. Thus, the liquid circulation apparatus 200 can maintain a damping performance of the pressure fluctuation at the maximum state.

In the second embodiment as described above, one of the first head tank 300*a* and the second head tank 300*b* among the first head tanks 300*a*, 300*c*, and 300*e* and the second head tanks 300*b*, 300*d*, and 300*f* include the photosensors 308*a* and 308*b*. All head tanks 300*a* through 300*f* may include the photosensors 308*a* and 308*b* to independently control the diaphragm 302 based on readings from the photosensors 308*a* and 308*b*. Then, the liquid circulation apparatus 200 can obtain the highest performance for damping the pressure fluctuation. However, the gas chambers 305 of the first head tanks 300*a*, 300*c*, and 300*e* communicate with each other, and the gas chambers 305 of the second head tanks 300*b*, 300*d*, and 300*f* communicate with each other in the second embodiment. Thus, the liquid circulation apparatus 200 according to the second embodiment controls the position of the diaphragm 302 based on the readings from the photosensors 308*a* and 308*b* provided to each of the first head tank 300*a* and the second head tank 300*b* to obtain an equivalent performance for damping the pressure fluctuation with a simple structure with low cost.

[Third Embodiment]

Figure 12A:
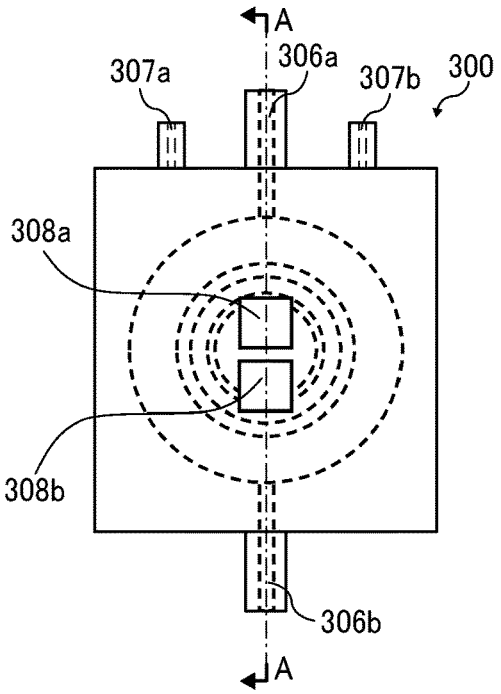
FIGS. 12A and 12B are a front view and a cross sectional view of a head tank, respectively, according to a third embodiment.
Figure 12B:
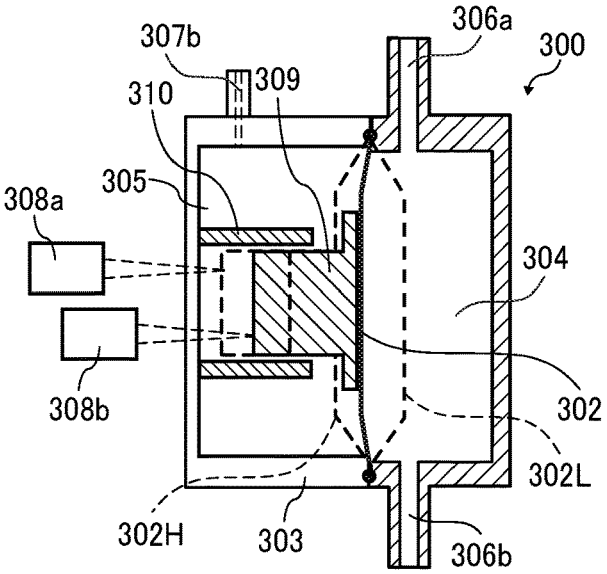
Figure 13:
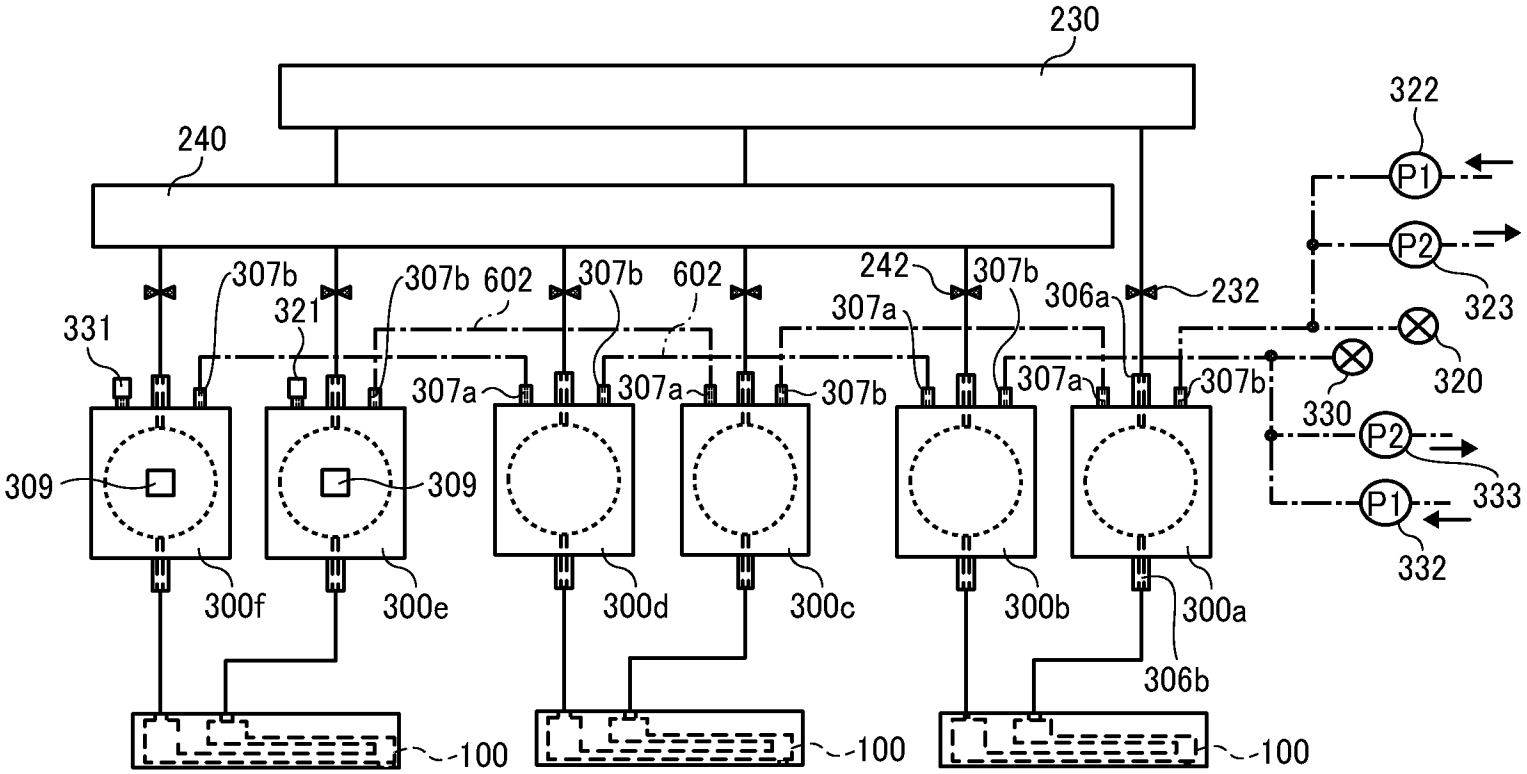
FIG. 13 is an exploded circuit diagram of the liquid circulation apparatus according to the third embodiment.

FIGS. 12A and 12B are schematic views of the head tank 300 of the liquid circulation apparatus 200 according the third embodiment. FIG. 12A is a front view of the head tank 300. FIG. 12B is a cross-sectional view along a line A-A in FIG. 12A. FIG. 13 is a circuit diagram of the liquid circulation apparatus 200 according to a third embodiment of the present disclosure.

The head tank 300 according to the third embodiment includes a cylindrical target 309 and a guide 310 for guiding the target 309. The target 309 serves as a detection target and is attached to the diaphragm 302. The guide 310 is provided on an inner surface of the casing 303.

Thus, at least one of the plurality of first head tanks 300*a* and the at least one of the plurality of second head tanks 300*b* includes the target 309 provided on the diaphragm 302 to move according to the displacement of the diaphragm 302 and the guide 310 to guide a movement of the target 309. The photosensors 308*a* and 308*b* detect a position of the target 309 to detect the displacement of the diaphragm 302.

The photosensors 308*a* and 308*b* are provided at positions facing the casing 303. The photosensors 308*a* and 308*b* serve as detectors for detecting a displacement of the diaphragm 302. Detection of the position of the target 309 by the two photosensors 308*a* and 308*b* can detect the position of the diaphragm 302.

In the liquid circulation apparatus 200 as illustrated in FIG. 13, at least one of the first head tanks 300*a*, 300*c*, and 300*e* (head tank 300*e* in FIG. 13) includes the photosensors 308*a* and 308*b* and the target 309 (see FIG. 12B). Further, at least one of the second head tanks 300*b*, 300*d*, and 300*f* (head tank 300*f* in FIG. 13) includes the photosensors 308*a* and 308*b* and the target 309. Remaining of the other four head tanks 300 (head tanks 300*a*, 300*b*, 300*c*, and 300*d* in FIG. 13) do not include the photosensors 308*a* and 308*b* and the target 309. It is to be noted that, in FIG. 13, an illustration of the photosensors 308*a* and 308*b* is omitted for simplicity. At this time, the head tank 300 including the photosensors 308*a*, 308*b*, and the target 309 are preferably disposed farthest from the air pumps P1 and P2.

As in the first and second embodiments (see FIGS. 8 and 11), all three first head tanks 300*a*, 300*c*, and 300*e* communicate with each other via the connection path 602. The air port 307*b* of the first head tank 300*a* is connected to the first air release valve 320. Further, the air port 307*a* of the first head tank 300*e* is sealed by the cap 321. Thus, the three first head tanks 300*a*, 300*c*, and 300*e* have a common closed space when the first air release valve 320 is closed.

Further, all three second head tanks 300*b*, 300*d*, 300*f* communicate with each other via a connection path 602. The air port 307*b* of the second head tank 300*b* is connected to the second air release valve 330. Further, the air port 307*a* of the second head tank 300*f* is sealed with the cap 331. Thus, the three second head tanks 300*b*, 300*d*, and 300*f* have a common closed space when the second air release valve 330 is closed.

A part of tubing communicating with the gas chamber 305 of the first head tank 300*a* is bifurcated to be connected to the first air intake pump 322 (P1) and a first air exhaustion pump 323 (P2).

A part of tubing communicating with the gas chamber 305 of the second head tank 300*b* is bifurcated to be connected to a second air intake pump 332 (P1) and a second air exhaustion pump 333 (P2).

Further, the diaphragms 302 of the first head tank 300*e* and the second head tank 300*f* that include the target 309 have a lower rigidity than the diaphragms 302 of the other head tanks 300 that do not include the target 309. Further, the head tank 300 that includes the target 309 is disposed at farthest from the air pumps P1 and P2. To lower rigidity of the diaphragm 302 of the head tank 300 including the target 309, a material having a lower elasticity than the diaphragms 302 of the other head tanks 300 may be used. Further, a thickness of the diaphragm 302 of the head tank 300 including the target 309 may be made thinner than the thickness of the diaphragms 302 of the other head tanks 300.

The plurality of first head tanks 300*a*, 300*c*, and 300*e* and the plurality of second head tanks 300*b*, 300*d*, and 300*f* include a head tank with the sensor (photosensors 308*a* and 308*b*), and a head tank without the sensor (photosensors 308*a* and 308*b*), and a rigidity of the diaphragm 302 of the head tank 300 with the sensor (photosensors 308*a* and 308*b*) is lower than a rigidity of the diaphragm 302 of the head tank 300 without the sensor (photosensors 308*a* and 308*b*).

Further, the head tank 300 with the sensor (photosensors 308*a* and 308*b*) is disposed farther from the air pump (first air intake pump 322, first air exhaustion pump 323, second air intake pump 332, and second air exhaustion pump 333) than the head tank 300 without the sensor (photosensors 308*a* and 308*b*).

The diaphragms 302 of the first head tank 300*e* and the second head tank 300*f* according to the third embodiment capable of detecting the displacement of the diaphragm 302 has a lower rigidity than the diaphragms 302 of the other first and second head tanks 300*a* through 300*d*. Therefore, as compared with the other first and second head tanks 300*a* through 300*d*, the diaphragms 302 of the first head tank 300*e* and the second head tank 300*f* displace with high sensitivity to the pressure of the liquid chamber 304. Thus, the liquid circulation apparatus 200 according to the third embodiment can accurately control damping of the pressure in the heads 100.

Further, the liquid circulation apparatus 200 according to the third embodiment includes the target 309 moving in conjunction with the diaphragm 302 and the guide 310 guiding and supporting the target 309. Thus, the diaphragms 302 of the first head tank 300*e* and the second head tank 300*f* can stably displace even if the diaphragms 302 have a low rigidity. Thus, the liquid circulation apparatus 200 can stably dampen the pressure in the heads 100.

Further, the first head tank 300*e* and the second head tank 300*f* capable of detecting the displacement of the diaphragm 302 is disposed at the farthest position from the air pumps P1 and P2. Thus, the liquid 400 is supplied to and discharged from the other first and second head tanks 300*a* through 300*d* in a shorter time. Thus, the liquid circulation apparatus 200 according to the third embodiment can easily increase the performance of damping the pressure in the head tanks 300 closer to the target.

[Fourth Embodiment]

Figure 14:
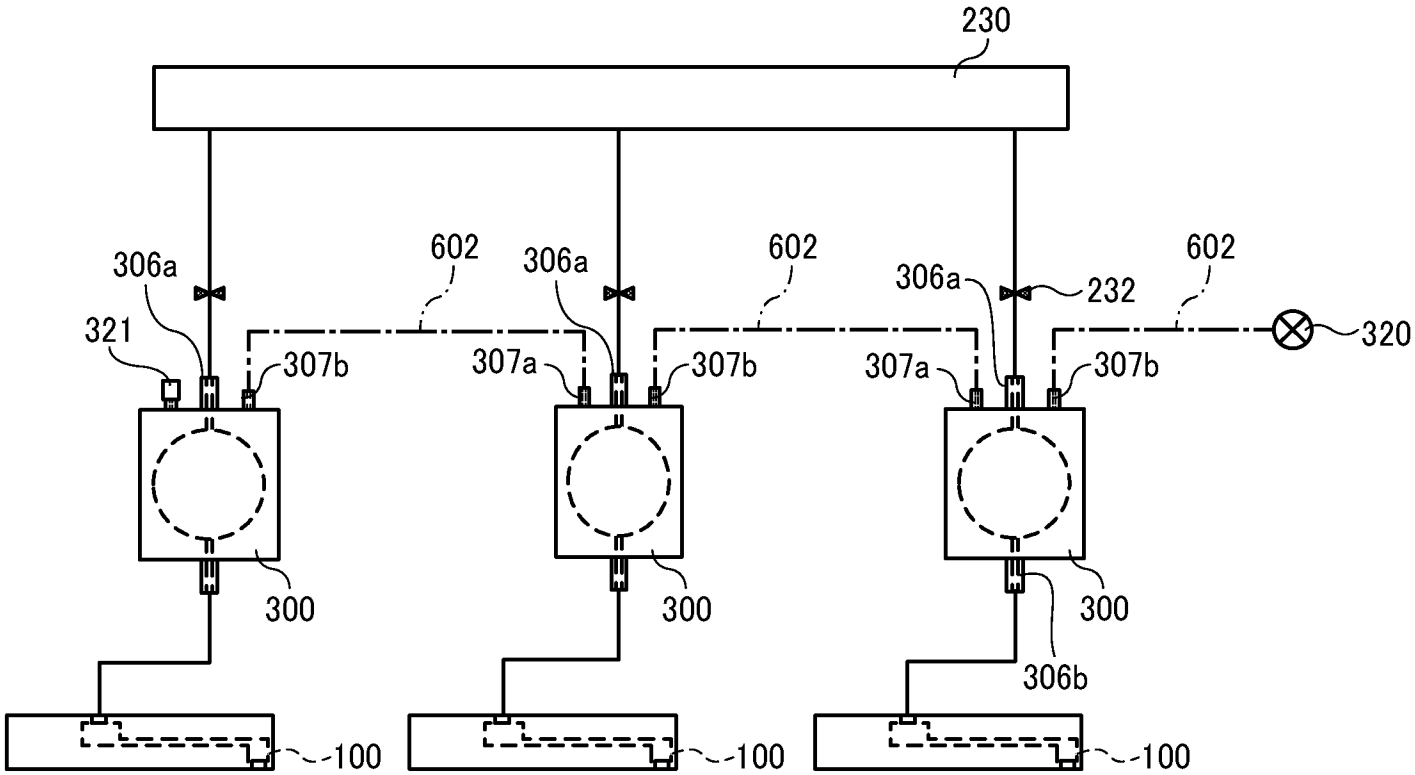
FIG. 14 is an exploded circuit diagram of the liquid circulation apparatus according to a fourth embodiment.

FIG. 14 is a circuit diagram of the liquid circulation apparatus 200 according to a fourth embodiment of the present disclosure. The heads 100 used in the liquid circulation apparatus 200 according to the fourth embodiment are non-circulation type heads and thus different from the heads 100 of each of the above-described embodiments. Thus, the heads 100 of the fourth embodiment in FIG. 14 do not include discharge port 181. Even when the head 100 of the non-circulation type is used, the pressure fluctuation may occur in the heads 100. Thus, the liquid circulation apparatus 200 according to the fourth embodiment can effectively reduce the pressure fluctuation by connecting the air ports 307*a* and 307*b* via the connection path 602.

[Fifth Embodiment]

Figure 15:
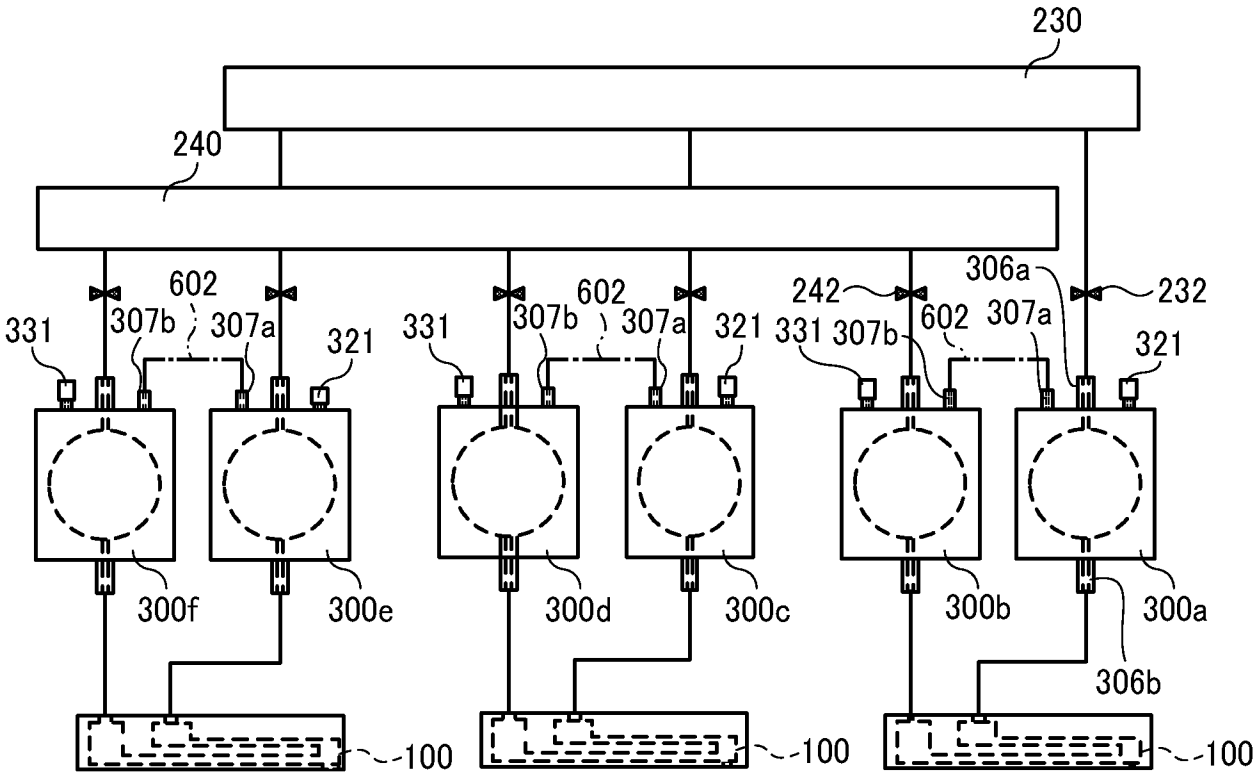
FIG. 15 is an exploded circuit diagram of the liquid circulation apparatus according to a fifth embodiment.

FIG. 15 is a circuit diagram of the liquid circulation apparatus 200 according to a fifth embodiment of the present disclosure. A destination of the connection path 602 in the fifth embodiment is different from the destination of the connection path 602 in the first to third embodiments as described above. Further, the connection path 602 connects the air port 307*a* of the first head tank 300*a* and the air port 307*b* of the second head tank 300*b*. Thus, the destination of the connection path 602 is not limited to between the first head tanks 300*a*, 300*c*, and 300*e* or between the second head tanks 300*b*, 300*d*, and 300*f*, and may be configured as described above.

In many cases, the pressure fluctuations of the supply-side head tanks (the first head tank 300*a*, 300*c*, and 300*e*) and the discharge-side head tanks (the second head tanks 300*b*, 300*d*, and 3000 are reversed. Therefore, the configuration as described in FIG. 15 can efficiently dampen the pressure fluctuation of the supply-side head tanks (first head tanks 300*a*, 300*c*, and 300*e*) by the discharge-side head tanks (second head tank 300*b*, 300*d*, and 300*f*).

[Sixth Embodiment]

Figure 16:
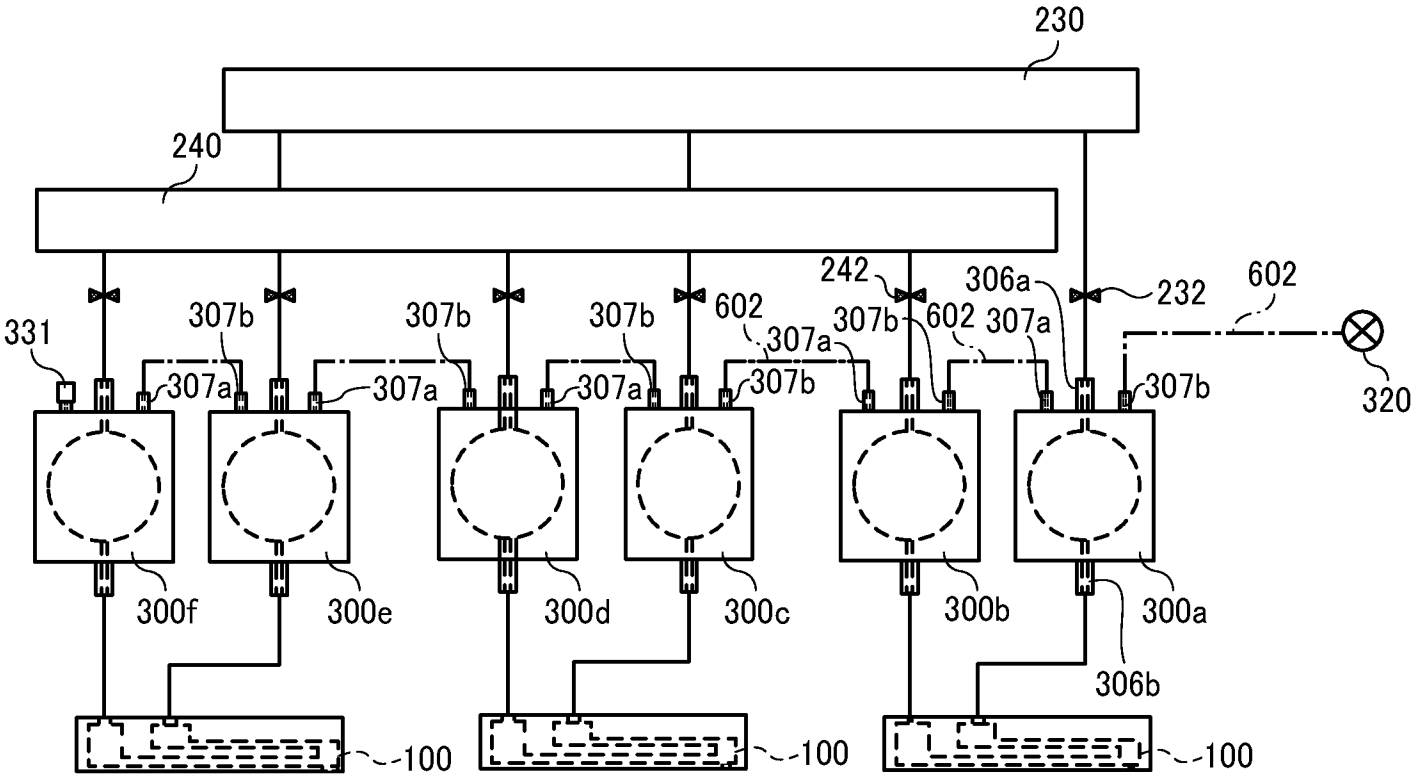
FIG. 16 is an exploded circuit diagram of the liquid circulation apparatus according to a sixth embodiment.

FIG. 16 is a circuit diagram of the liquid circulation apparatus 200 according to a sixth embodiment of the present disclosure. The liquid circulation apparatus 200 according to the sixth embodiment is different from the above-described fifth embodiment in which the second head tank 300*b* and the first head tank 300*c* adjacent to the second head tank 300*b*, and the second head tank 300*d* and the first head tank 300*e* adjacent to the second head tank 300*d* are further connected by the connection path 602. Note that in FIG. 16, the respective first and second head tanks 300*b*, 300*c*, 300*d*, and 300*e* are adjacent to each other. However, the actual arrangement is not limited to that which is described above. In FIG. 16, the connection path 602 connects the air port 307*a* of the first head tank 300*a* and the air port 307*b* of the second head tank 300*b*, and another connection path 602 connects the air port 307*b* of the first head tank 300*c* and the air port 307*a* of the second head tank 300*b*. Further, one of the first and second head tanks 300 (first head tank 300*a* in FIG. 16) is connected to the first air release valve 320. The configuration in the sixth embodiment can obtain a damping effect with a simpler configuration in which only one first air release valve 320 is provided.

In the present disclosure, discharged "liquid" is not limited to a particular liquid as long as the liquid has a viscosity or surface tension to be discharged from a head. However, preferably, the viscosity of the liquid is not greater than 30 mPa·s under ordinary temperature and ordinary pressure or by heating or cooling. Specific examples of such liquids include, but are not limited to, solutions, suspensions, and emulsions containing solvents (e.g., water, organic solvents), colorants (e.g., dyes, pigments), functionality imparting materials (e.g., polymerizable compounds, resins, surfactants), biocompatible materials (e.g., DNA (deoxyribonucleic acid), amino acid, protein, calcium), and edible materials (e.g., natural colorants). Such liquids can be used as inkjet inks, surface treatment liquids, liquids for forming compositional elements of electric or luminous elements or electronic circuit resist patterns, and 3D modeling material liquids.

The "liquid discharge head" includes an energy source for generating energy to discharge liquid. Examples of the energy source include a piezoelectric actuator (a laminated piezoelectric element or a thin-film piezoelectric element), a thermal actuator that employs a thermoelectric conversion element, such as a heating resistor (element), and an electrostatic actuator including a diaphragm and opposed electrodes.

In the present disclosure, "liquid discharge apparatus" refers to an apparatus including a liquid discharge head or a liquid discharge unit, configured to discharge a liquid by driving the liquid discharge head. The liquid discharge apparatus may be, for example, an apparatus capable of discharging liquid onto a material to which liquid can adhere or an apparatus to discharge liquid into gas or another liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, on which the liquid has been discharged.

The "liquid discharge apparatus" may be, for example, an image forming apparatus to form an image on a sheet by discharging ink, or a three-dimensional fabricating apparatus to discharge a fabrication liquid to a powder layer in which powder material is formed in layers, so as to form a three-dimensional fabrication object.

In addition, "the liquid discharge apparatus" is not limited to such an apparatus to form and visualize meaningful images, such as letters or figures, with discharged liquid. For example, the liquid discharge apparatus may be an apparatus to form meaningless images, such as meaningless patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "medium on which liquid can be adhered" include recording media, such as paper sheet, recording paper, recording sheet of paper, film, and cloth, electronic component, such as electronic substrate and piezoelectric element, and media, such as powder layer, organ model, and testing cell. The "medium on which liquid can be adhered" includes any medium on which liquid is adhered, unless particularly limited.

Examples of "the material on which liquid can be adhered" include any materials on which liquid can be adhered even temporarily, such as paper, thread, fiber, fabric, leather, metal, plastic, glass, wood, and ceramic.

"The liquid discharge apparatus" may be an apparatus to relatively move a head and a medium on which liquid can be adhered. However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet surface to coat the sheet surface with the treatment liquid to reform the sheet surface and an injection granulation apparatus to eject a composition liquid including a raw material dispersed in a solution from a nozzle to mold particles of the raw material.

The terms "image formation", "recording", "printing", "image printing", and "fabricating" used herein may be used synonymously with each other.

Numerous additional modifications and variations are possible in light of the above teachings. Such modifications and variations are not to be regarded as a departure from the scope of the present disclosure and appended claims, and all such modifications are intended to be included within the scope of the present disclosure and appended claims.

What is claimed is:

1. A liquid discharge apparatus comprising:

a plurality of liquid discharge heads to discharge liquid; and a plurality of head tanks communicating with the plurality of liquid discharge heads, respectively, each of the plurality of head tanks including a liquid chamber to store the liquid and a gas chamber separated from the liquid chamber by a diaphragm, and the gas chamber of one of the plurality of head tanks communicating with the gas chamber of another of the plurality of head tanks.

2. The liquid discharge apparatus according to claim 1, further comprising a liquid channel through which the liquid is circulated via the plurality of liquid discharge heads, wherein each of the plurality of liquid discharge heads includes a supply port and a discharge port, wherein the plurality of head tanks includes:

a plurality of first head tanks connected to the discharge port of the plurality of liquid discharge heads, respectively; and a plurality of second head tanks connected to the discharge port of the plurality of liquid discharge heads, respectively, wherein the gas chamber of one of the plurality of first head tanks communicates with the gas chamber of another of the plurality of first head tanks.

3. The liquid discharge apparatus according to claim 2, wherein the gas chamber of one of the plurality of second head tanks communicates with the gas chamber of another of the plurality of second head tanks.

4. The liquid discharge apparatus according to claim 2, further comprising:

a first manifold disposed upstream of the plurality of first head tanks in a circulation direction of the liquid; and a second manifold disposed downstream of the plurality of second head tanks in the circulation direction of the liquid.

5. The liquid discharge apparatus according to claim 2, wherein at least one of the gas chamber of the plurality of first head tanks and at least one of the gas chamber of the plurality of second head tanks are communicable with atmosphere via a valve.

6. The liquid discharge apparatus according to claim 5, wherein the diaphragm is flexible.

7. The liquid discharge apparatus according to claim 6, further comprising:

a sensor disposed at each of at least one of the plurality of first head tanks and at least one of the plurality of second head tanks to detect displacement of the diaphragm; and an air pump connected to the gas chamber of the at least one of the plurality of first head tanks and the at least one of the plurality of second head tanks to take air into and discharge air from the gas chamber.

8. The liquid discharge apparatus according to claim 7, wherein each of the at least one of the plurality of first head tanks and the at least one of the plurality of second head tanks includes:

a target provided on the diaphragm to move according to displacement of the diaphragm; and a guide to guide a movement of the target, wherein the sensor detects a position of the target to detect displacement of the diaphragm.

9. The liquid discharge apparatus according to claim 7, wherein the plurality of head tanks includes a head tank with the sensor and a head tank without the sensor, wherein a rigidity of the diaphragm of the head tank with the sensor is lower than a rigidity of the diaphragm of the head tank without the sensor.

10. The liquid discharge apparatus according to claim 7, wherein the plurality of head tanks includes a head tank with the sensor and a head tank without the sensor, wherein the head tank with the sensor is disposed farther from the air pump than the head tank without the sensor.

11. The liquid discharge apparatus according to claim 1, further comprising a liquid channel through which the liquid is circulated via the plurality of liquid discharge heads, wherein each of the plurality of liquid discharge heads includes a supply port and a discharge port, wherein the plurality of head tanks includes:

a plurality of first head tanks connected to the discharge port of the plurality of liquid discharge heads, respectively; and a plurality of second head tanks connected to the discharge port of the plurality of liquid discharge heads, respectively, wherein the gas chamber of one of the plurality of first head tanks communicates with the gas chamber of one of the plurality of second head tanks.

* * * * *